US009563151B2

(12) United States Patent
Sato

(10) Patent No.: US 9,563,151 B2
(45) Date of Patent: Feb. 7, 2017

(54) PACKAGING UNIT INCLUDING IMAGE FORMING APPARATUS TO WHICH CARTRIDGE ACCOMMODATING DEVELOPER IS DETACHABLY MOUNTED AND PACKAGING MEMBER IN WHICH IMAGE FORMING APPARATUS IS PACKAGED

(75) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1460 days.

(21) Appl. No.: 13/315,760

(22) Filed: Dec. 9, 2011

(65) Prior Publication Data

US 2012/0160717 A1 Jun. 28, 2012

(30) Foreign Application Priority Data

Dec. 24, 2010 (JP) ..... 2010-288092

(51) Int. Cl.
*G03G 15/08* (2006.01)

(52) U.S. Cl.
CPC *G03G 15/0896* (2013.01); *G03G 2215/00008* (2013.01); *G03G 2215/0875* (2013.01); *G03G 2215/0886* (2013.01)

(58) Field of Classification Search
CPC ..... G03G 15/0896; G03G 21/1604; G03G 2215/00008; G03G 2215/00012; G03G 2215/0875; G03G 2215/0886
USPC ..... 399/108
See application file for complete search history.

(56) References Cited

U.S. PATENT DOCUMENTS 6,431,362 B1 * 8/2002 Araki ..... G03G 15/0896 206/485
7,636,529 B2 * 12/2009 Kamimura ..... B65D 81/113 206/320
7,992,715 B2 * 8/2011 Kwon ..... G03G 15/08 206/320
2003/0209464 A1 * 11/2003 Otsuka ..... B65D 81/113 206/586
2005/0008400 A1 * 1/2005 Tazawa ..... G03G 15/0855 399/263
2005/0169664 A1 * 8/2005 Arimitsu ..... G03G 21/1832 399/111

(Continued)

FOREIGN PATENT DOCUMENTS

JP 2000199995 A * 7/2000
JP 2001278342 A * 10/2001

(Continued)

*Primary Examiner* — Robert Beatty
(74) *Attorney, Agent, or Firm* — Banner & Witcoff, Ltd.

(57) ABSTRACT

A packaging unit includes an image forming apparatus and a packaging member. A cartridge is detachably mounted in the image forming apparatus. The cartridge accommodates developer therein. The image forming apparatus is configured to form an image using the developer. The cartridge is formed with a first opening for allowing the developer to discharge outside from the cartridge when the cartridge is in a first posture. The cartridge is in the first posture when the image is formed. The packaging member packages the image forming apparatus therein in such a posture that the cartridge is in a second posture where leakage of the developer from the first opening is unlikely to occur as compared with a posture of the image forming apparatus in which the cartridge is in the first posture.

15 Claims, 22 Drawing Sheets

(56) References Cited

U.S. PATENT DOCUMENTS

| | | | | |
|---|---|---|---|---|
| 2006/0045562 | A1* | 3/2006 | Choi | B65D 81/113 399/103 |
| 2007/0077099 | A1* | 4/2007 | Ota | G03G 15/0875 399/258 |

FOREIGN PATENT DOCUMENTS

| | | | | |
|---|---|---|---|---|
| JP | 2002293376 | A | * | 10/2002 |
| JP | 2006098491 | A | * | 4/2006 |
| JP | 2006-220877 | | | 8/2006 |
| JP | 2007-193239 | | | 8/2007 |

* cited by examiner (a)

(b)

PACKAGING UNIT INCLUDING IMAGE FORMING APPARATUS TO WHICH CARTRIDGE ACCOMMODATING DEVELOPER IS DETACHABLY MOUNTED AND PACKAGING MEMBER IN WHICH IMAGE FORMING APPARATUS IS PACKAGED

CROSS REFERENCE TO RELATED APPLICATION

This application claims priority from Japanese Patent Application No. 2010-288092 filed Dec. 24, 2010. The entire content of the priority application is incorporated herein by reference.

TECHNICAL FIELD

The present invention relates to an packaging unit

BACKGROUND

One example of a conventional electrophotographic image-forming device well known in the art is a printer provided with a detachably mounted toner cartridge for accommodating toner. Methods for packaging this type of printer for the purposes of shipping, for example, have been studied. In one method, the body of the printer and the toner cartridge are packaged in separate boxes, while other methods package the printer body and toner cartridge in the same box, with the toner cartridge outside of the printer body.

In both packaging methods described above, the toner cartridge is removed from the printer body for shipping. Consequently, a larger number of boxes is required when packaging the printer body and toner cartridge separately, and the size of the box increases when the printer body and toner cartridge are packaged together.

SUMMARY

Therefore, it is an object of the present invention to provide a packaging method for packaging an image-forming device by which the image-forming device and toner cartridge can be compactly accommodated while preventing toner contamination to the image-forming device and toner cartridge. It is another object of the present invention to provide a packaging unit for packaging the image-forming device according to the packaging method.

In order to attain the above and other objects, the invention provides a packaging unit including an image forming apparatus and a packaging member. A cartridge is detachably mounted in the image forming apparatus. The cartridge accommodates developer therein. The image forming apparatus is configured to form an image using the developer. The cartridge is formed with a first opening for allowing the developer to discharge outside from the cartridge when the cartridge is in a first posture. The cartridge is in the first posture when the image is formed. The packaging member packages the image forming apparatus therein in such a posture that the cartridge is in a second posture where leakage of the developer from the first opening is unlikely to occur as compared with a posture of the image forming apparatus in which the cartridge is in the first posture.

According to another aspect, the present invention provides a method comprising: mounting a cartridge into an image forming apparatus, the cartridge accommodating developer therein, the image forming apparatus being configured to form an image using the developer, the cartridge being formed with a first opening for allowing the developer to discharge outside from the cartridge when the cartridge is in a first posture, the cartridge being in the first posture when the image is formed; and packaging the image forming apparatus in a packaging member in such a posture that the cartridge is in a second posture where leakage of the developer from the first opening is unlikely to occur as compared with a posture of the image forming apparatus in which the cartridge is in the first posture.

According to another aspect, the present invention provides a packaging unit including an image forming apparatus and a packaging member. A cartridge is detachably mounted into the image forming apparatus. The image forming apparatus is configured to form an image using the developer. The cartridge accommodates developer therein. The cartridge is formed with an opening and having an edge defining the opening. The opening allows the developer to discharge outside from the cartridge when at least part of the edge is positioned at a position lower than a level of the developer accommodated in the cartridge. The image forming apparatus is packaged in the packaging member in such a posture that the entire edge is positioned at a position higher than the level of the developer accommodated in the cartridge.

BRIEF DESCRIPTION OF THE DRAWINGS

The particular features and advantages of the invention as well as other objects will become apparent from the following description taken in connection with the accompanying drawings, in which:

FIG. 5(*b*) is a perspective view of the input member when the input member is disposed at a retracted position in the first embodiment;

FIG. 5(*c*) is an upper view of the input member when the input member is disposed at the protruding position in the first embodiment;

FIG. 14(*b*) is an upper view of the toner cartridge shown in FIG. 14(*a*);

DETAILED DESCRIPTION

Figure 1:
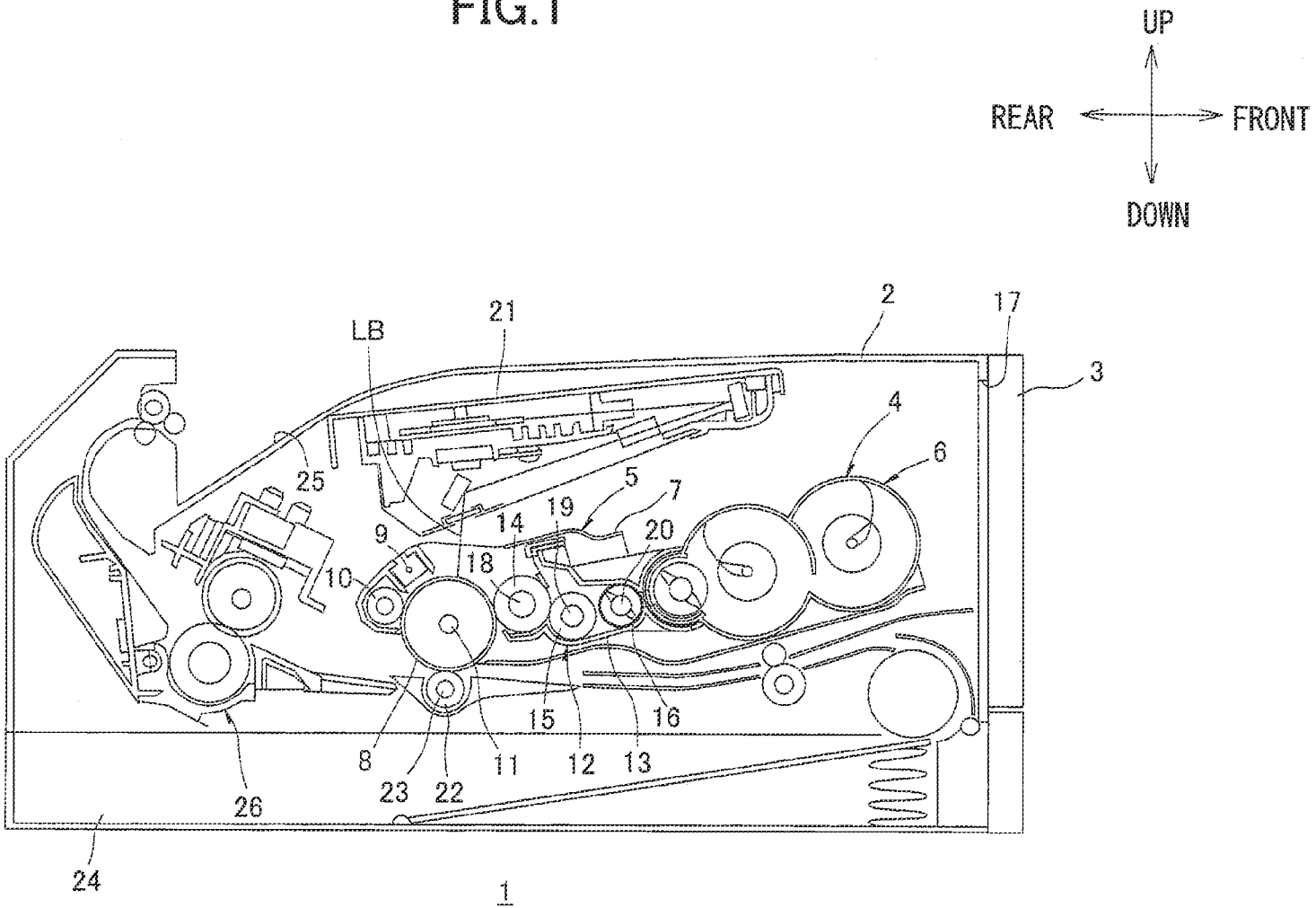
FIG. 1 is a schematic cross-sectional view of a color laser printer as an image forming apparatus according to a first embodiment of the present invention.

A packaging unit according to embodiments of the invention will be described while referring to the accompanying drawings wherein like parts and components are designated by the same reference numerals to avoid duplicating description.

The terms "upward", "downward", "upper", "lower", "above", "below", "beneath", "right", "left", "front", "rear" and the like will be used throughout the description assuming that an image forming apparatus of the packaging unit is disposed in an orientation in which it is intended to be used. In use, the image forming apparatus is disposed as shown in FIG. 1.

1. Laser Printer

As shown in FIG. 1, a laser printer 1 is provided with a main casing 2. An access opening 17 is formed in the front surface of the main casing 2. A front cover 3 is rotatably provided on the front surface of the main casing 2 and can be rotated between a second closed position for covering the access opening 17 and a second open position for exposing the access opening 17.

In the following description, the side of the laser printer 1 faced by a user operating the same (i.e., the side on which the front cover 3 is provided) will be referred to as the "front side," and rear, up, down, left, and right directions will be defined based on the user's perspective when observing any component of the laser printer 1 from the front side.

Figure 12:
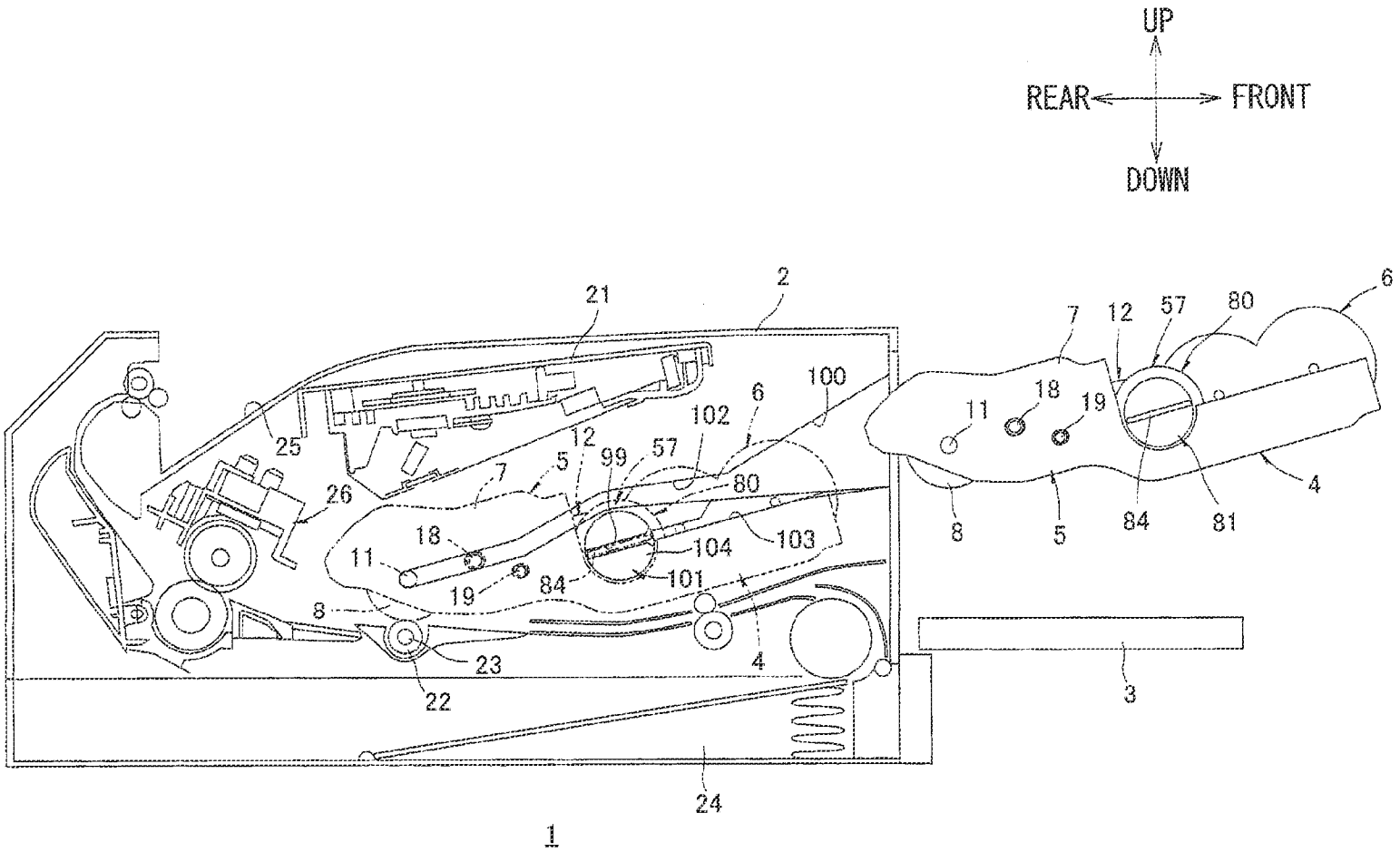
FIG. 12 is a cross-sectional view showing the color laser printer in a state that the process cartridge is installed in the color laser printer in the first embodiment.

The main casing 2 is also provided with a process cartridge 4. As shown in FIGS. 1 and 12, the process cartridge 4 can be mounted in or removed from the main casing 2 through the access opening 17 when the front cover 3 is in the second open position. The process cartridge 4 includes a drum cartridge 5, and a toner cartridge 6. The toner cartridge 6 holds toner and is detachably mounted on the drum cartridge 5.

The drum cartridge 5 includes a drum frame 7. The drum frame 7 retains a photosensitive drum 8, a charger 9, and a cleaner 10 in the rear end portion thereof.

The photosensitive drum 8 has a drum shaft 11 oriented in the left-to-right direction and is disposed in the drum frame 7 so as to be rotatable about the drum shaft 11.

The charger 9 is disposed diagonally rearward and above the photosensitive drum 8, while the cleaner 10 is disposed on the rear side of the photosensitive drum 8.

A developing device 12 is retained in the drum cartridge 5 at a position forward from the photosensitive drum 8. The developing device 12 includes a developing device case 13 and, a developing roller 14, a supply roller 15, and an auger 16 are provided inside the developing device case 13.

The developing roller 14 has a developing roller shaft 18 oriented in the left-to-right direction and is provided in the developing device case 13 so as to be rotatable about the developing roller shaft 18. Part of the peripheral surface of the developing roller 14 is exposed in the rear end of the developing device case 13 and contacts the peripheral surface of the photosensitive drum 8 on the front side thereof.

The supply roller 15 is disposed on the front lower side of the developing roller 14. The supply roller 15 includes a supply roller shaft 19 oriented in the left-to-right direction and is provided in the developing device case 13 so as to be rotatable about the supply roller shaft 19. The peripheral surface of the supply roller 15 is in contact with the peripheral surface of the developing roller 14.

The auger 16 is disposed in front of the supply roller 15. The auger 16 has an auger shaft 20 oriented in the left-to-right direction and is provided in the developing device case 13 so as to be rotatable about the auger shaft 20.

Toner in the toner cartridge 6 can be supplied into the developing device case 13 when the toner cartridge 6 is mounted on the drum cartridge 5. Toner provided to the developing device case 13 is supplied from the peripheral surface of the supply roller 15 to the peripheral surface of the developing roller 14 by the rotations of the developing roller 14 and supply roller 15. Toner supplied to the developing roller 14 is carried on the surface of the developing roller 14 as a thin layer of uniform thickness. In short, the developing device 12 is configured of the toner cartridge 6 and a developing unit.

An exposure unit 21 is disposed inside the main casing 2 above the process cartridge 4. The exposure unit 21 is provided with a laser light source or the like for emitting a laser beam LB toward the surface of the photosensitive drum 8.

During image formation, the photosensitive drum 8 rotates at a constant speed clockwise when viewed from the left side. While the photosensitive drum 8 rotates, the charger 9 applies a uniform charge to the peripheral surface of the photosensitive drum 8 through corona discharge, after which the exposure unit 21 irradiates the laser beam LB onto the charged surface. The electric charge is selectively removed from areas of the surface of the photosensitive drum 8 that were exposed to the laser beam LB, forming an electrostatic latent image thereon. As the photosensitive drum 8 rotates and brings the electrostatic latent image opposite the developing roller 14, toner is transferred from the developing roller 14 to the latent image, producing a toner image on the surface of the photosensitive drum 8.

A transfer roller 22 is disposed inside the main casing 2 beneath the photosensitive drum 8. The transfer roller 22 has a transfer roller shaft 23 oriented in the left-to-right direction and is provided so as to be rotatable about the transfer roller shaft 23.

A paper cassette 24 is provided in the bottom section of the main casing 2 for accommodating sheets of paper. Various rollers feed the paper one sheet at a time from the front end of the paper cassette 24 to a transfer position between the photosensitive drum 8 and the transfer roller 22.

As the sheets of paper pass between the photosensitive drum 8 and transfer roller 22, toner images are transferred from the surface of the photosensitive drum 8 onto the paper. After toner images are transferred onto the paper, the sheets are conveyed to a fixing unit 26. In the fixing unit 26, the toner images are fixed to the paper by heat and pressure. After the images are formed on the paper, the sheets of paper are discharged into a discharge tray 25.

Figure 2:
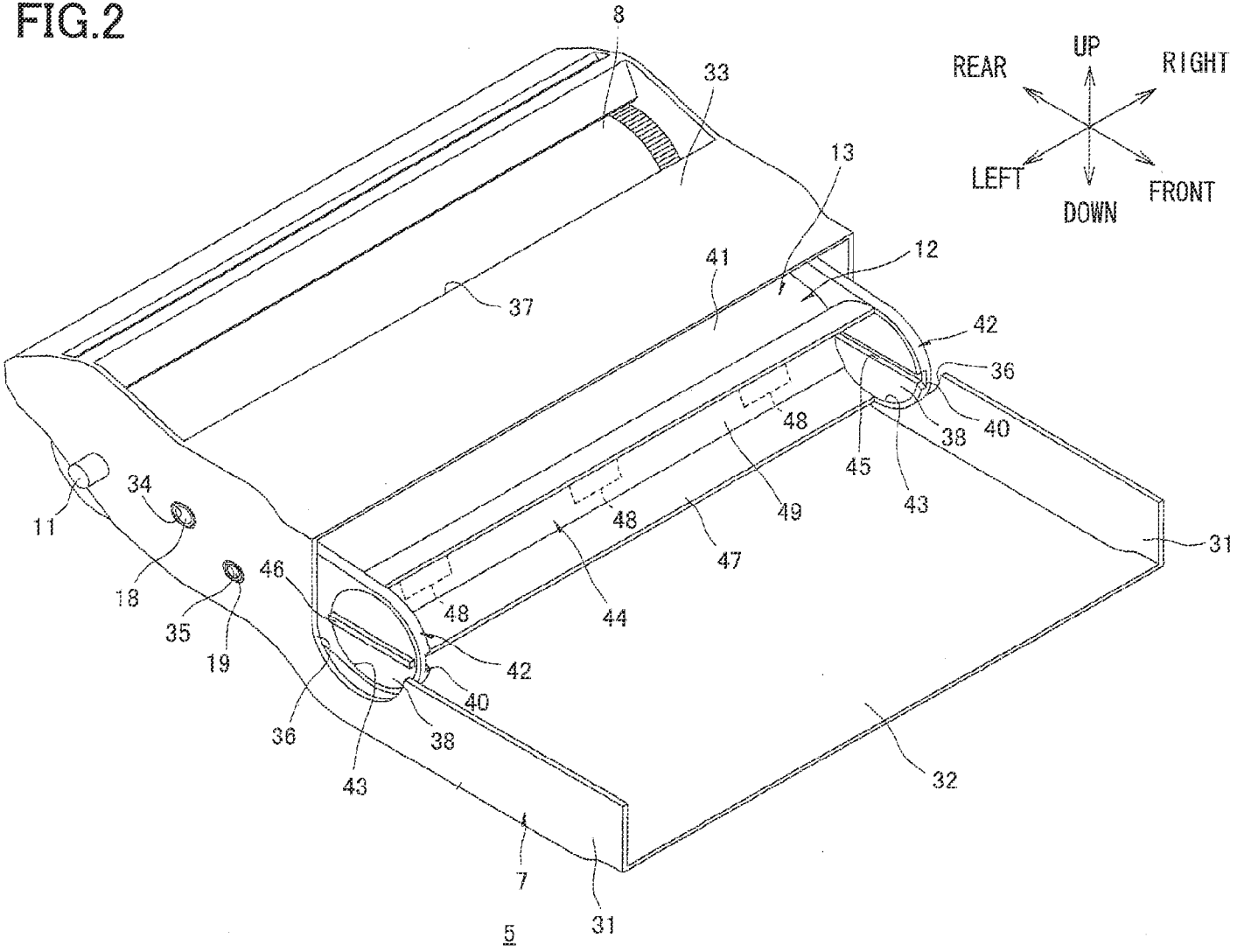
FIG. 2 is a perspective view of a drum cartridge provided in the color laser printer as viewed from a upper, front, right side in the first embodiment.

2. Detailed Description of the Process Cartridge (1) Drum Cartridge (1-1) Drum Frame As shown in FIG. 2, the drum frame 7 includes a pair of side plates 31 arranged parallel to each other and separated in the left-to-right direction, a bottom plate 32 bridging the lower edges of the side plates 31, and a top plate 33 bridging the top edges of the side plates 31 in approximately the rear half of the same.

Both ends of the drum shaft 11 provided in the photosensitive drum 8 penetrate the corresponding side plates 31 near the rear ends thereof and protrude outward from the same. With this configuration, the photosensitive drum 8 is rotatable about the drum shaft 11 while interposed between the left and right side plates 31.

Developing roller shaft receiving holes 34 are formed in both side plates 31 at positions in front of and separated from the drum shaft 11. The developing roller shaft receiving holes 34 are elongated holes that penetrate the side plates 31. The developing roller shaft receiving holes 34 are elongated in the front-to-rear direction and have a greater vertical dimension than the diameter of the developing roller shaft 18. The left and right ends of the developing roller shaft 18 are rotatably inserted into the corresponding developing roller shaft receiving holes 34.

Supply roller shaft receiving holes 35 are also formed in both side plates 31 at positions diagonally forward and below the developing roller shaft receiving holes 34 and separated therefrom. The supply roller shaft receiving holes 35 are elongated holes that penetrate the side plates 31. The supply roller shaft receiving holes 35 are elongated in the front-to-rear direction and have a greater vertical dimension than the diameter of the supply roller shaft 19. Left and right ends of the supply roller shaft 19 are rotatably inserted into the corresponding supply roller shaft receiving holes 35.

Cutout parts 36 are formed in the side plates 31 at positions forward and separated from the supply roller shaft receiving holes 35. The cutout parts 36 are substantially U-shaped and open upward.

Figure 7:
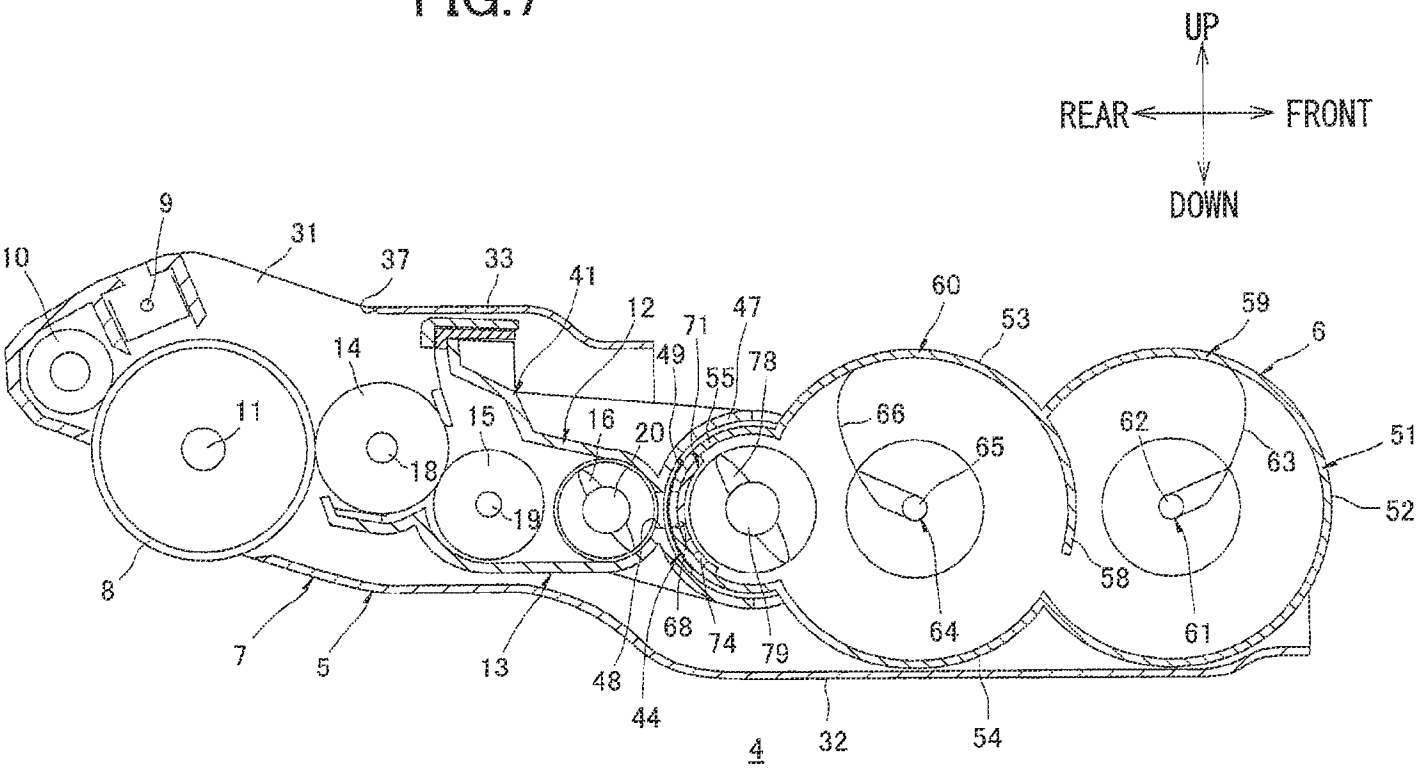
FIG. 7 is a cross-sectional view of the process cartridge shown in FIG. 6 in the first embodiment.

The bottom plate 32 bridges the bottom edges of the side plates 31, extending between the front edges of the side plates 31 and a position confronting the front peripheral surface of the photosensitive drum 8 (see FIG. 7). With this construction, the peripheral surface of the photosensitive drum 8 is exposed on the bottom to the rear of the bottom plate 32.

The top plate 33 bridges the top edges of the side plates 31 in the rear half of the same. The top plate 33 is positioned such that the front edge thereof is substantially flush with the rear edges of the cutout parts 36 in a side view.

An opening 37 is formed in the top plate 33 in the portion opposing the photosensitive drum 8 from above. The opening 37 spans the entire left-to-right width of the top plate 33. With this construction, the peripheral surface of the photosensitive drum 8 is exposed on the top through the opening 37. The laser beam LB emitted from the exposure unit 21 (see FIG. 1) passes through the opening 37 and is irradiated onto the peripheral surface of the photosensitive drum 8. The charger 9 and cleaner 10 are accommodated inside the top plate 33 farther rearward than the opening 37.

(1-2) Developing Device

As shown in FIGS. 2 and 7, the developing device case 13 is integrally provided with a main body part 41 and shutter support parts 42. The main body part 41 accommodates the developing roller 14, supply roller 15, and auger 16. The shutter support parts 42 are plate-shaped and extend forward from the left and right ends of the main body part 41. Each shutter support part 42 extends forward from the main body part 41 to a position confronting the cutout parts 36 of the drum frame 7 in the left-to-right direction. The front ends of the shutter support parts 42 are substantially arc-shaped.

Retaining holes 43 are formed in the shutter support parts 42, penetrating the shutter support parts 42 in the left-to-right direction. The retaining holes 43 are substantially circular in a side view.

Guide parts 40 are formed in the left and right inner surfaces of the corresponding shutter support parts 42 at positions along the front edges thereof. Each guide part 40 is formed as a groove that extends from the front edge of the corresponding shutter support part 42 in the front-to-rear direction and is in communication with the corresponding retaining hole 43. The width of the groove shape is tapered so as to grow narrower toward the rear. The width of the groove on the rear edge of the guide part 40 is substantially equivalent to the width of the groove shape formed by a first engaging part 45 described later.

The developing device case 13 has a front wall 47 formed in a curved plate shape. The front wall 47 curves along the rear half of the peripheral edges of the retaining holes 43. The front wall 47 bridges the left and right shutter support parts 42 and is continuously formed with the main body part 41 near the circumferential center of the front wall 47. Three developer openings 48 (see FIG. 2) are formed in the vertical center portion of the front wall 47 connected to the main body part 41. The developer openings 48 are substantially rectangular in shape and are spaced at intervals in the left-to-right direction (one in the left-to-right center and one each on left and right ends). Thus, the developer openings 48 provide communication between the interior and exterior of the main body part 41.

The developing device 12 is also provided with a developing shutter 44 for opening and closing the developer openings 48. The developing shutter 44 has a partial cylindrical shape and is elongated in the front-to-rear direction. The left and right ends of the developing shutter 44 are rotatably supported in the retaining holes 43. More specifically, the developing shutter 44 is integrally provided with a pair of left and right operating parts 38 and a cover part 49. The operating parts 38 are rotatably fitted inside the corresponding retaining holes 43. The cover part 49 has a curved plate shape and bridges the operating parts 38.

The operating parts 38 are substantially disc-shaped and have a thickness nearly identical to the shutter support parts 42. The first engaging parts 45 are formed in the left and right inner surfaces of the corresponding operating parts 38. Each first engaging part 45 is a groove formed in the corresponding operating part 38 so as to extend diametrically through the center of the operating part 38, spanning the entire diameter of the same. Second engaging parts 46 are formed on the left and right outer surfaces of the corresponding operating parts 38. The second engaging parts 46 are ridge-like protrusions that extend through the center of the corresponding operating parts 38, spanning the entire diameter of the same. The second engaging parts 46 overlap the first engaging parts 45 when the two are projected in the left-to-right direction.

The cover part 49 extends in the left-to-right direction and is formed in a curved plate shape that conforms to the curve in the front wall 47 of the developing device case 13. The left and right edges of the cover part 49 are connected to the corresponding operating parts 38. Hence, the cover part 49 moves together with the operating parts 38. The cover part 49 is configured to cover the developer openings 48 when the first engaging parts 45 and second engaging parts 46 are oriented in the front-to-rear direction, as shown in FIG. 2.

The first engaging part 45 is rotated between a closed position (see FIG. 7) in which the cover part 49 covers the front side of the developer openings 48, and an open position (see FIG. 9) in which the cover part 49 is separated from the developer openings 48, thus exposing the same.

When the developing shutter 44 is in the closed position, the first engaging parts 45 are in communication with the corresponding guide parts 40.

(2) Toner Cartridge

Figure 3:
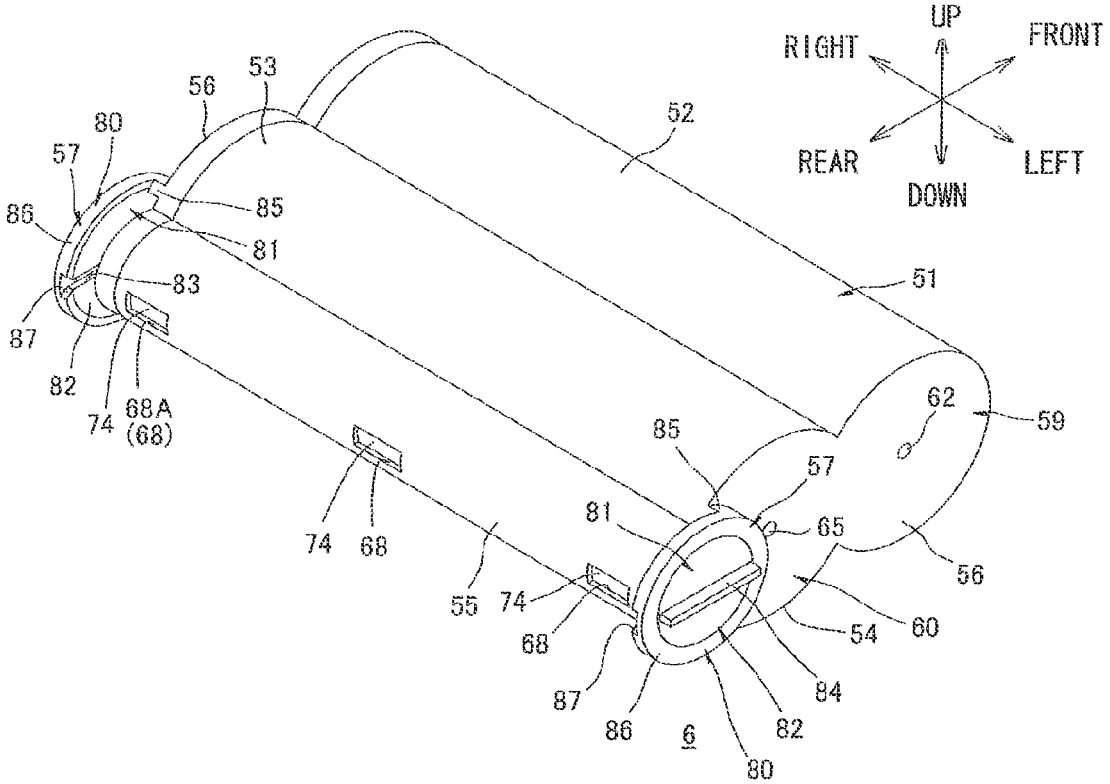
FIG. 3 is a perspective view of a toner cartridge mounted to the color laser printer as viewed from a upper, rear, left side in the first embodiment.
Figure 4:
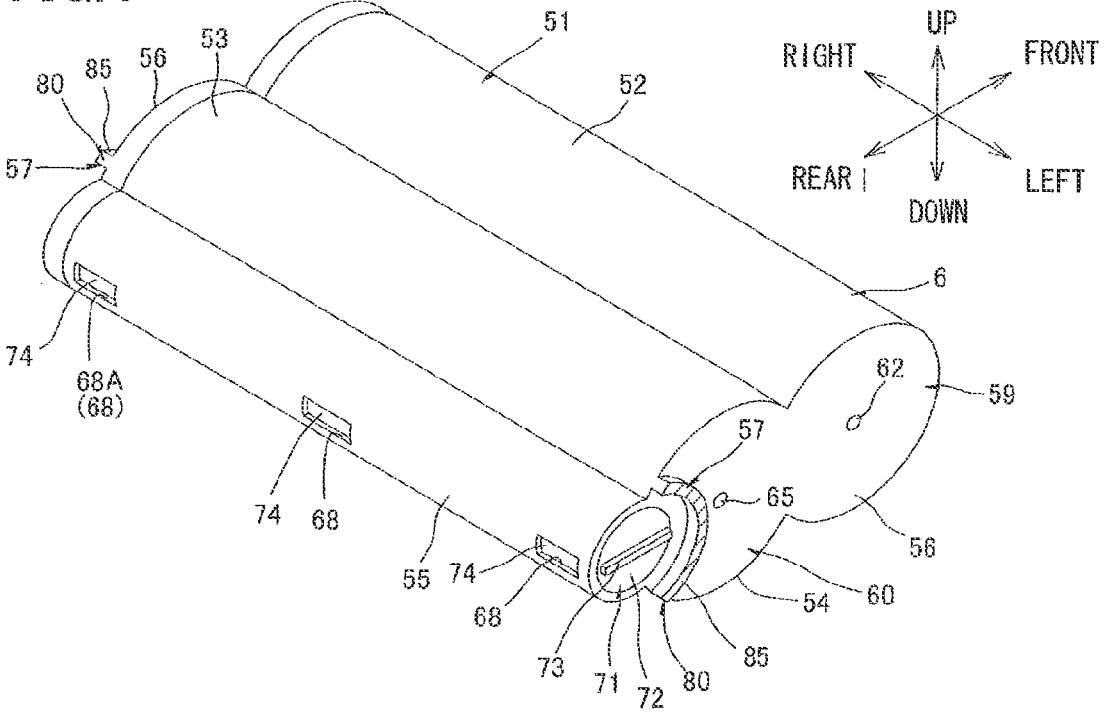
FIG. 4 is a partial cross-sectional view of the toner cartridge shown in FIG. 3.

As shown in FIGS. 3 and 4, the toner cartridge 6 is provided with a cartridge case 51. The cartridge case 51 is formed in the shape of three hollow cylindrical members aligned diametrically and joined together.

Specifically, the cartridge case 51 is integrally provided with a first peripheral wall 52 elongated in the left-to-right direction and having a C-shaped cross section opening rearward; a first arcing wall 53 that is arc-shaped in a cross section, with the convex side facing upward, and that is connected to the upper rear edge of the first peripheral wall 52; a second arcing wall 54 that is arc-shaped in a cross section, with the convex side facing downward, and that is connected to the lower rear edge of the first peripheral wall 52; and a second peripheral wall 55 that is C-shaped in a cross section and open toward the front, the diameter of the arc-shaped outer surface being substantially the same as the inner diameter of the front wall 47 constituting the developing device 12, and that is connected to the rear edges of the first and second arcing walls 53 and 54. The cartridge case 51 is also integrally provided with a pair of left and right side walls 56 for enclosing the space defined by the first peripheral wall 52, first arcing wall 53, and second arcing wall 54 from the left and right sides.

As shown in FIG. 7, a partitioning wall 58 is provided inside the cartridge case 51. The partitioning wall 58 has an arcing plate shape and extends downward from the junction between the first peripheral wall 52 and first arcing wall 53 along the circumferential direction of the first arcing wall 53. The left and right edges of the partitioning wall 58 are connected to the corresponding left and right side walls 56. A gap is formed between the lower edge of the partitioning wall 58 and the junction between the first peripheral wall 52 and second arcing wall 54.

The partitioning wall 58 partitions the space encompassed by the first peripheral wall 52 and the space defined by the first and second arcing walls 53 and 54 into a first toner accommodating section 59 and a second toner accommodating section 60. The first and second toner accommodating sections 59 and 60 are in communication through the gap formed between the lower edge of the partitioning wall 58 and the junction between the first peripheral wall 52 and second arcing wall 54. With the toner cartridge 6 according to the first embodiment, both the first toner accommodating section 59 and second toner accommodating section 60 are filled with toner and, hence, constitute the overall toner accommodating section.

An agitator 61 is provided inside the first toner accommodating section 59. The agitator 61 includes an agitator shaft 62 that is rotatably held in the left and right side walls 56, and an agitating film 63 supported on the agitator shaft 69.

An agitator 64 is disposed in the second toner accommodating section 60. The agitator 64 has an agitator shaft 65 rotatably held in the left and right side walls 56, and an agitating film 66 supported on the agitator shaft 65.

Three toner cartridge openings 68 are formed in the rear side of the second peripheral wall 55 in the circumferential center thereof. The toner cartridge openings 68 are substantially rectangular and spaced at intervals in the left-to-right direction at positions corresponding to the three developer openings 48 (see FIG. 7). With this construction, the toner cartridge openings 68 are positioned in opposition to the developer openings 48 when the toner cartridge 6 is mounted in the drum cartridge 5.

As shown in FIGS. 4 and 7, a cartridge shutter 71 having a partial cylindrical shape is rotatably provided inside the second peripheral wall 55. The cartridge shutter 71 is elongated in the left-to-right direction and is rotatably supported in the second peripheral wall 55, with the left and right endfaces of the cartridge shutter 71 exposed in the left and right ends of the second peripheral wall 55.

Specifically, the cartridge shutter 71 is integrally provided with a pair of left and right operating parts 72 that are rotatably fitted inside the left and right ends of the second peripheral wall 55, and a cover part 74 having a curved plate shape that spans between the operating parts 72.

The operating parts 72 are substantially disc-shaped, and their outer left and right endfaces are substantially flush with the left and right ends of the second peripheral wall 55. An engagement part 73 is formed on the outer surface of each of the left and right operating parts 72. The first engagement parts 73 are ridge-like protrusions extending along a diameter of the operating parts 72 and can engage with the corresponding first engaging parts 45.

The cover part 74 is elongated in the left-to-right direction and has a curved plate shape that conforms to the curve of the second peripheral wall 55. The left and right edges of the cover part 74 are connected to the operating parts 72. Thus, the cover part 74 can move together with the operating parts 72. The cover part 74 is positioned so as to cover the toner cartridge openings 68 when the first engagement parts 73 are aligned in the front-to-rear direction.

Hence, the cartridge shutter 71 can be rotated between a first closed position (see FIG. 7) in which the cover part 74 covers the toner cartridge openings 68 on the front side for restricting the discharge of toner, and a first open position (see FIG. 9) in which the cover part 74 is retracted from the toner cartridge openings 68, thus exposing the toner cartridge openings 68 and allowing the discharge of toner.

An auger 78 is provided inside the second peripheral wall 55. The auger 78 has an auger shaft 79 aligned in the left-to-right direction and is rotatable about the auger shaft 79.

Figure 5:
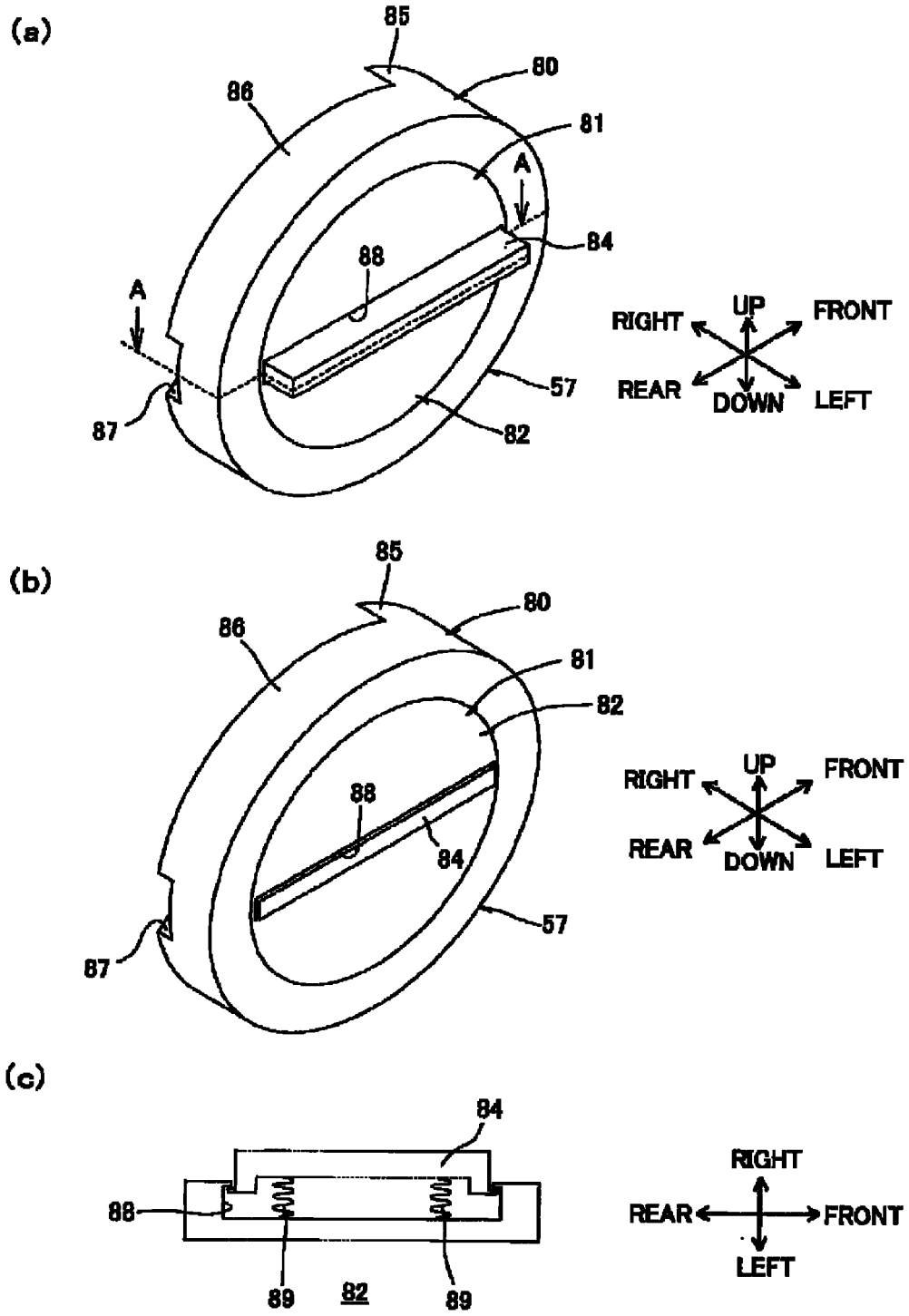
FIG. 5(*a*) is a perspective view of an input member provided on the toner cartridge when the input member is disposed at a protruding position in the first embodiment.

As shown in FIGS. 3 through 5(*c*), the cartridge case 51 also has shutter operating units 57, with one on each of the left and right sides of the second peripheral wall 55 and cartridge shutter 71. The shutter operating units 57 are substantially disc-shaped and oppose the second peripheral wall 55 and cartridge shutter 71 in the left and right directions while separated therefrom.

The shutter operating units 57 have a larger diameter than that of the second peripheral wall 55 and are disposed so as to share the same central axis as the cartridge shutter 71. Each shutter operating unit 57 includes an operating unit frame 80 that is substantially annular in shape, and an operating member 81 that is substantially disc-shaped. The operating member 81 is rotatably fitted inside the operating unit frame 80.

The operating unit frame 80 is integrally configured of a receiving part 85 and a support part 86. The receiving part 85 is arc-shaped in a cross-sectional view, opening rearward, and extends from the rear edge of the corresponding side wall 56 constituting the cartridge case 51 outward in the left-to-right direction. The support part 86 is substantially annular in shape and is formed continuously with the left and right outer edge of the receiving part 85.

The inner periphery of the receiving part 85 has substantially the same curvature as the outer periphery of the front edge of the shutter support part 42 (see FIG. 2) and is capable of receiving this front edge of the shutter support part 42. The receiving part 85 also has a longer left-to-right dimension than that of the first engagement part 73.

The support part 86 has an outer diameter substantially equivalent to that of the receiving part 85. The front edge of the support part 86 is connected to the receiving part 85 so that the support part 86 protrudes rearward therefrom. A guide part 87 is formed in the rear edge of the support part 86 on the inner surface side with respect to the left-to-right direction.

The guide part 87 is a groove extending forward from the rear edge of the support part 86 along a radial to the same so as to pass radially from the outer side of the support part 86 to the inner side. The guide part 87 has a tapered shape, growing narrower toward the front. The width of the groove on the front edge of the guide part 87 is substantially equivalent to that of a second engagement part 83.

The operating member 81 is provided with a fitting member 82 and an input member 84. The fitting member 82 is substantially disc-shaped and is fitted inside the support part 86. The input members 84 protrude outward in left and right directions from the corresponding outer left and right surfaces of the fitting members 82.

Formed in each fitting member 82 are a second engagement part 83 (see FIG. 3), and an input member accommodating part 88.

The second engagement part 83 is a groove formed in the left or right inner surface of the corresponding fitting member 82 and extends diametrically through the center of the fitting member 82, spanning the entire diameter thereof.

The input member accommodating part 88 is a groove cut out from the outer surface of the fitting member 82 inward in the left or right direction and extends along a diameter of the fitting member 82.

The input member 84 is substantially rod-shaped, extending in a diametrical direction of the fitting member 82, and is slidably fitted into the corresponding input member accommodating part 88 in the left-to-right direction. The input member 84 can be slid between a protruding position protruding outward in the left-to-right direction from the outer surface of the corresponding fitting member 82 (see FIG. 5(*a*)), and a retracted position retracted inside the input member accommodating part 88 so that the outer surface in the left-to-right direction is substantially flush with the outer surface of the fitting member 82 (see FIG. 5(*b*)).

As shown in FIG. 5(*c*), compressed springs 89 are connected on one end to a bottom wall (inner wall with respect to the left-to-right direction) of the corresponding input member accommodating part 88 and on the other end to the inner side of the input member 84 with respect to the left-to-right direction. The compressed springs 89 constantly urge the input member 84 toward the protruding position.

When the fitting member 82 is rotated so that the input member 84 is aligned in the front-to-rear direction, as shown in FIG. 3, the second engagement part 83 and guide part 87 are in communication with each other.

(3) Mounting and Removing the Toner Cartridge Relative to the Drum Cartridge

Operations for mounting the toner cartridge 6 on and removing the toner cartridge 6 from the drum cartridge 5 will be described next with reference to FIGS. 2 and 3.

When the toner cartridge 6 is separated from the drum cartridge 5, the developing shutter 44 of the drum cartridge 5 is in the closed position shown in FIG. 2. Thus, the cover part 49 of the developing shutter 44 confronts and closes the developer openings 48.

Further, the cartridge shutter 71 is disposed in the first closed position and the operating members 81 of the toner cartridge 6 have been rotated so that the corresponding second engagement parts 83 and input members 84 are aligned in the front-to-rear direction, as shown in FIGS. 3 and 4. At this time, the cover part 74 of the cartridge shutter 71 opposes and closes the toner cartridge openings 68.

The toner cartridge 6 is mounted on the drum cartridge 5 from the front side. Specifically, first the toner cartridge 6 is positioned in front of the drum cartridge 5. Next, the drum cartridge 5 and toner cartridge 6 are placed at the same vertical position such that the first engagement parts 73 are aligned with the first engaging parts 45 and the second engagement parts 83 are aligned with the second engaging parts 46. Subsequently, the toner cartridge 6 is assembled to the front of the drum cartridge 5 by inserting the shutter support parts 42 of the drum cartridge 5 between the cartridge shutter 71 and corresponding shutter operating units 57 of the toner cartridge 6.

During this operation, the first engagement parts 73 are guided by the guide parts 40 into the first engaging parts 45, while the second engaging parts 46 are guided by the guide parts 87 into the corresponding second engagement parts 83.

At this time, the first engaging parts 45 of the drum cartridge 5 are engaged with the first engagement parts 73 of the toner cartridge 6, while the second engaging parts 46 of the drum cartridge 5 are engaged with the second engagement parts 83 of the toner cartridge 6. Accordingly, the operating members 81, the developing shutter 44, and the cartridge shutter 71 are rotatably interlocked.

When the front end of the second peripheral wall 55 contacts the cover part 49 of the developing shutter 44, as shown in FIG. 7, the operation for mounting the toner cartridge 6 on the drum cartridge 5 is complete.

Figure 6:
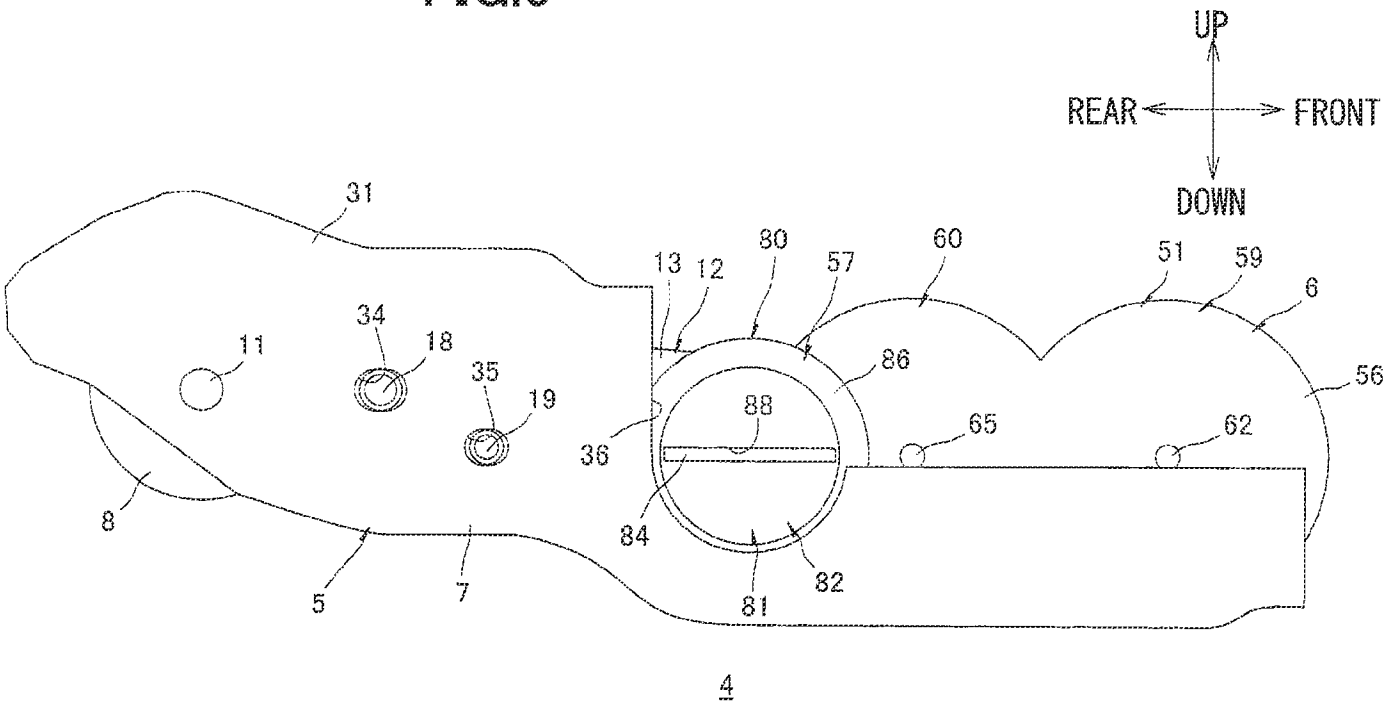
FIG. 6 is a side view of a process cartridge provided on the image forming apparatus in a state that a shutter operating unit is at a closed position in the first embodiment.

After the toner cartridge 6 has been completely mounted on the drum cartridge 5, the operating members 81 oppose the corresponding cutout parts 36 in the drum frame 7 with respect to the left and right directions and are exposed outside the corresponding left and right cutout parts 36, as shown in FIG. 6.

Figure 8:
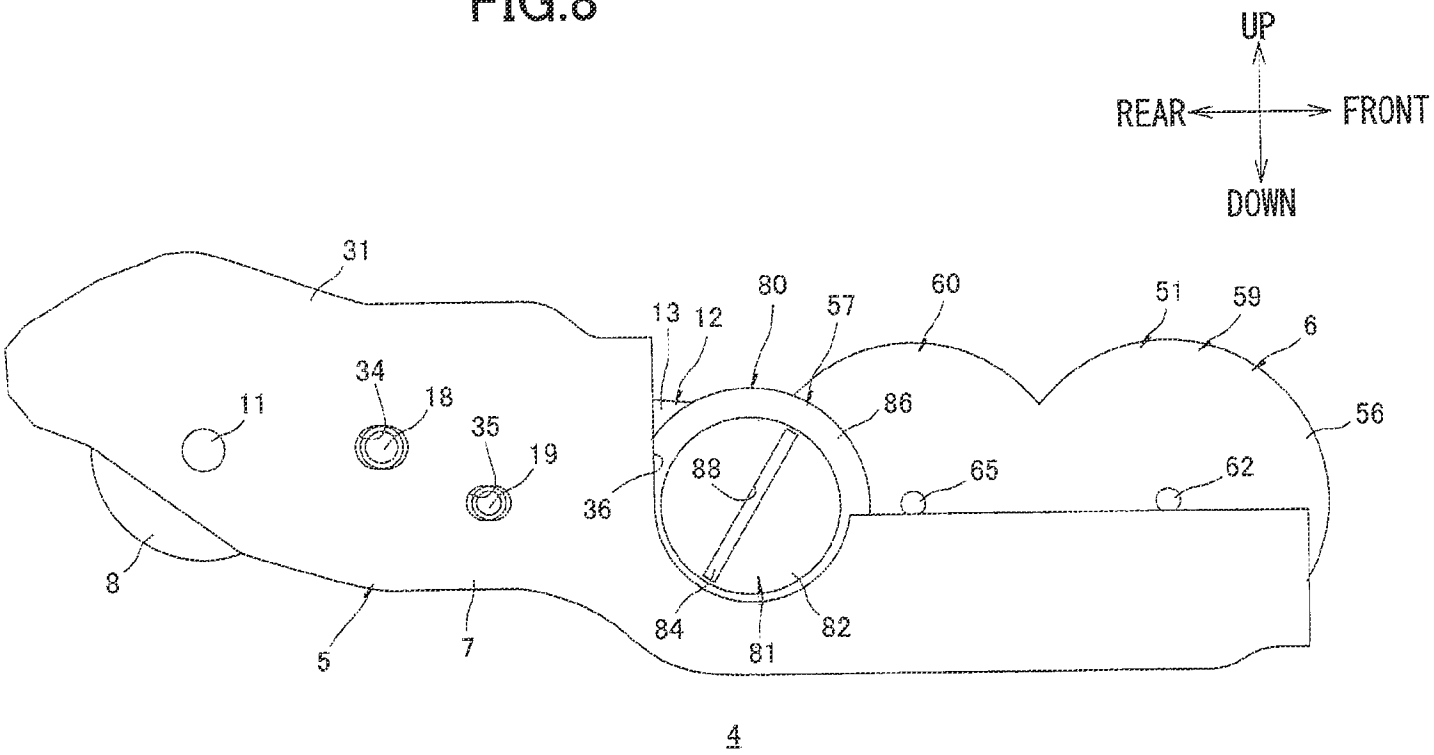
FIG. 8 is a side view of a process cartridge provided on the image forming apparatus in a state that a shutter operating unit is at an open position in the first embodiment.
Figure 9:
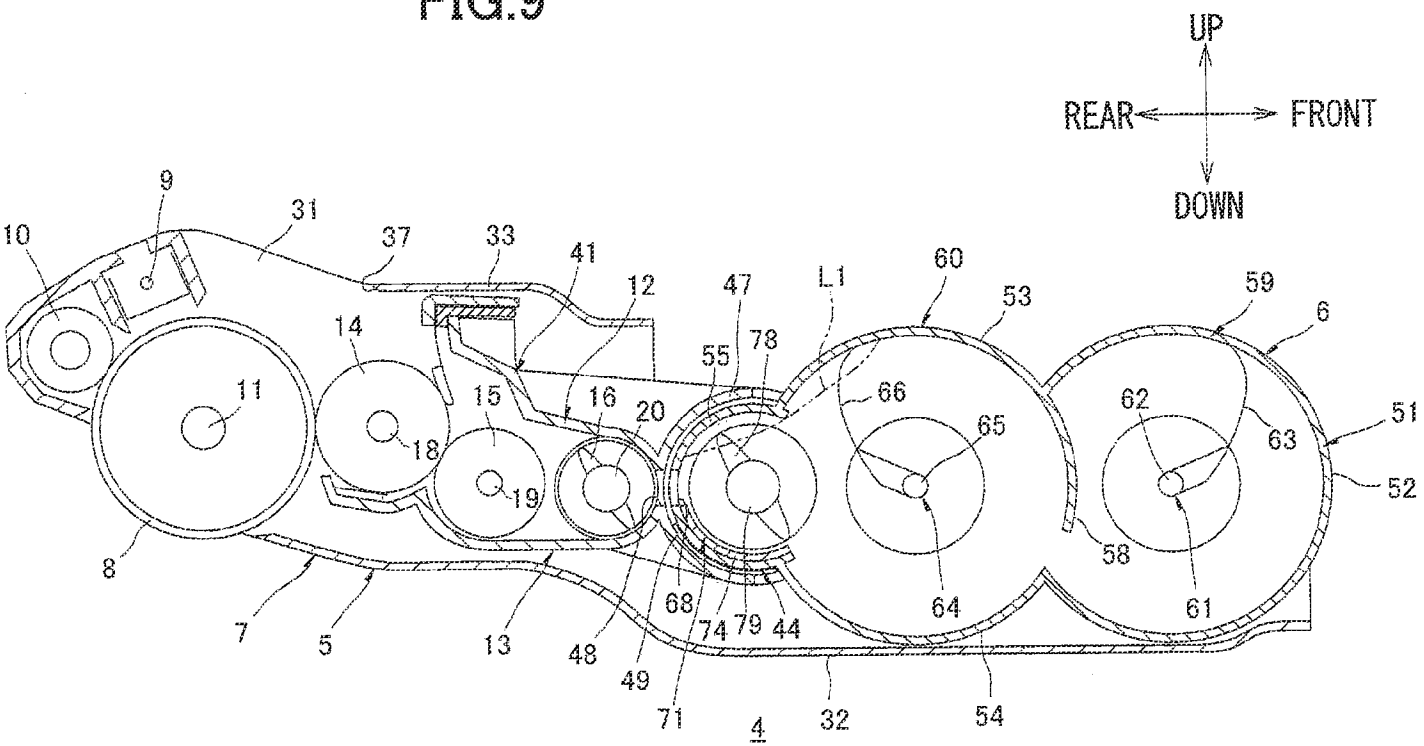
FIG. 9 is a cross-sectional view of the process cartridge shown in FIG. 8.

If the operating members 81 are rotated a prescribed angular distance counterclockwise in a left side view, as shown in FIG. 8, the developing shutter 44 of the drum cartridge 5 is rotated counterclockwise in a left side view into its open position, as illustrated in FIG. 9. When the developing shutter 44 is rotated in this way, the cover part 49 of the developing shutter 44 slides down below the developer openings 48, thereby allowing communication between the developer openings 48 and the toner cartridge openings 68. At the same time, the cartridge shutter 71 of the toner cartridge 6 is rotated counterclockwise in a left side view into its first open position. When the cartridge shutter 71 is rotated in this way, the cover part 74 of the cartridge shutter 71 slides down below the toner cartridge openings 68, thereby opening the toner cartridge openings 68 and allowing communication between the toner cartridge 6 and developing device 12.

4. Detailed Description of the Main Casing

Figure 10:
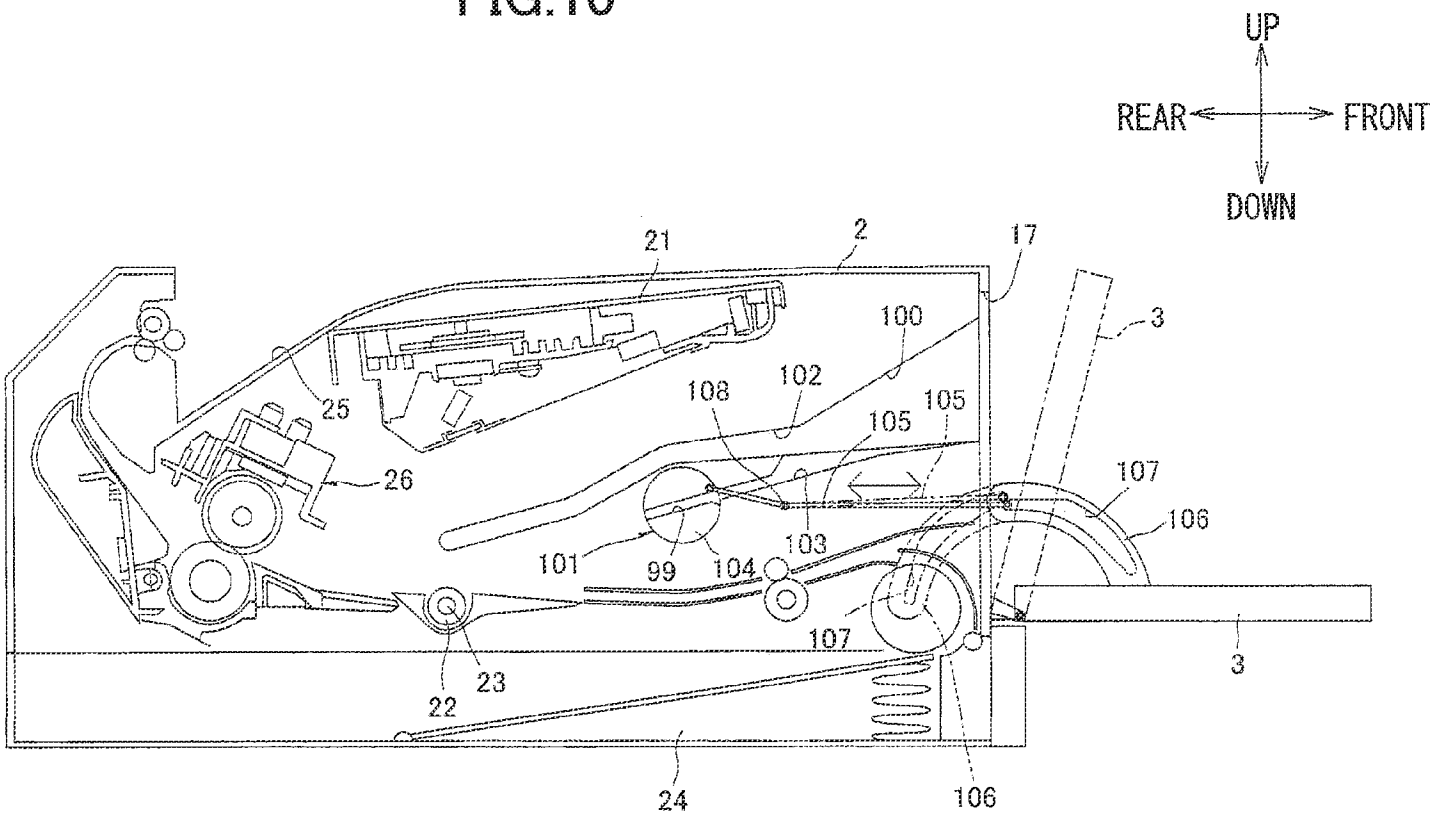
FIG. 10 is a cross-sectional view showing the color laser printer in a state that a front cover is opened in the first embodiment.

As shown in FIG. 10, the main casing 2 includes guide grooves 100 for guiding the process cartridge 4 when the process cartridge 4 is mounted in or removed from the main casing 2, and opening and closing mechanisms 101 for operating the operating members 81 to open and close the developing shutter 44.

The guide grooves 100 are formed in the inner surfaces of the left and right side walls constituting the main casing 2, with one guide groove 100 formed in each side wall. Each guide groove 100 is configured of a first guide groove 102, and a second guide groove 103. The first guide groove 102 begins from the front edge of the side wall and extends rearward in substantially a horizontal direction, but subsequently bends and follows a downward slope toward the rear end. The second guide groove 103 branches off the front end of the first guide groove 102 and slopes further downward toward the rear than the first guide groove 102.

The first guide grooves 102 extend from the front edge of the main casing 2 to a position above the transfer roller 22 and function to receive and guide the drum shaft 11 of the photosensitive drum 8.

The second guide grooves 103 lead to a position below the approximate front-to-rear center of the first guide grooves 102 and serve to receive and guide the input members 84 of the operating members 81.

One of the opening and closing mechanisms 101 is provided in each of the left and right side walls of the main casing 2. The opening and closing mechanisms 101 operate the operating members 81 in association with the opening and closing operation of the front cover 3.

More specifically, each opening and closing mechanism 101 includes a rotating member 104 that is fitted onto the corresponding input member 84, and a coupling member 105 for connecting the rotating member 104 to the front cover 3.

The rotating member 104 is substantially circular in a side view and is rotatably embedded in the corresponding side wall of the main casing 2. A fitting groove 99 is formed in the rotating member 104 for fitting the input member 84 therein. The fitting groove 99 extends along a diametrical direction of the rotating member 104 and spans the entire diameter of the same.

The rotating member 104 can be rotated between a first position (see FIG. 10) in which the fitting groove 99 is in communication with the corresponding second guide groove 103, and a second position (see FIG. 11) rotated counterclockwise in a left side view a prescribed angular distance from the first position.

The coupling member 105 is substantially rod-shaped and aligned in the front-to-rear direction. The rear end of the coupling member 105 is connected to a peripheral edge portion of the rotating member 104, while the front end is connected to the front cover 3. A hinge part 108 is provided in a front-to-rear midpoint of the coupling member 105, enabling the coupling member 105 to bend.

The front cover 3 is provided with coupling arms 106 that are substantially arc-shaped in a side view. A coupling hole 107 is formed in each coupling arms 106 and is elongated in an arc shape that follows the shape of the coupling arms 106. The front ends of the coupling members 105 are coupled in the coupling holes 107 of the corresponding coupling arms 106 and are capable of sliding within the coupling holes 107.

When the front cover 3 is in its open state, the front ends of the coupling members 105 are positioned in the rearmost ends of the coupling holes 107. By opening the front cover 3 in this way, the rotating members 104 are moved to their first position by the coupling members 105.

When the front cover 3 is closed, the front ends of the coupling members 105 slide to the front ends of the coupling holes 107 as the front cover 3 rotates. When the front ends of the coupling members 105 reach the front ends of the coupling holes 107, the front cover 3 is still slightly open, as indicated by the broken lines in FIG. 10.

Figure 11:
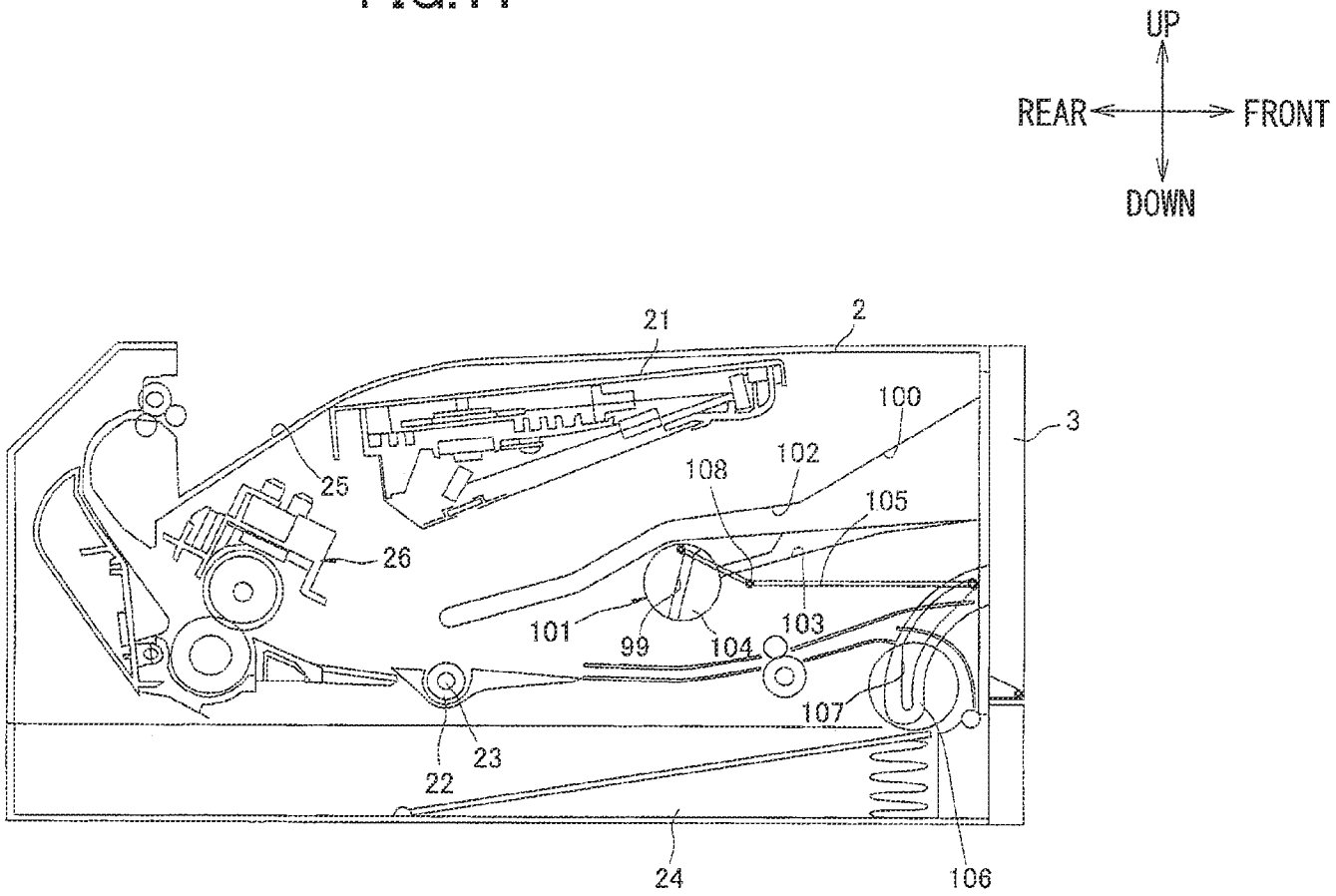
FIG. 11 is a cross-sectional view showing the color laser printer in a state that the front cover is closed in the first embodiment.

When the operator pushes the front cover 3 completely closed, as shown in FIG. 11, the coupling arms 106 press the front ends of the coupling members 105 rearward, forcing the coupling members 105 to move rearward while rotating the rotating members 104 counterclockwise in a left side view. Thus, the rotating members 104 are moved to their second position.

5. Mounting and Removing the Process Cartridge Relative to the Main Casing

As shown in FIG. 12, the process cartridge 4 is mounted in the main casing 2 while the front cover 3 is in its open state. To mount the process cartridge 4 into the main casing 2, both ends of the drum shaft 11 in the photosensitive drum 8 are inserted into the corresponding first guide grooves 102, and the process cartridge 4 is pushed rearward. As the process cartridge 4 moves rearward, both ends of the drum shaft 11 are guided in the first guide grooves 102.

At the point the rear half of the process cartridge 4 has been inserted into the main casing 2 and the operating members 81 are beginning to advance into the main casing 2, the input members 84 of the operating members 81 enter the corresponding second guide grooves 103.

As the process cartridge 4 continues to move rearward, the ends of the drum shaft 11 are guided in the first guide grooves 102 while the input members 84 on the operating members 81 are guided in the second guide grooves 103. As a result, the process cartridge 4 moves along a downward slope toward the rear.

When the ends of the drum shaft 11 arrive at the rear ends of the first guide grooves 102, the process cartridge 4 is completely mounted in the main casing 2 and the input members 84 of the operating members 81 are fitted into the fitting grooves 99 of the rotating members 104. When the front cover 3 is closed after the process cartridge 4 has been completely mounted in this way, the coupling members 105 of the opening and closing mechanisms 101 move rearward, rotating the rotating members 104, as described above. As the rotating members 104 are rotated, the operating members 81 also rotate a prescribed angular distance counterclockwise in a left side view.

As described above, in association with this rotation of the operating members 81, the developing shutter 44 is moved from the closed position to the open position, and the cartridge shutter 71 is moved from the first closed position to the first open position. As a result, the toner cartridge 6 is now in communication with the developing device 12.

In order to remove the process cartridge 4 from the main casing 2, the procedure for mounting the process cartridge 4 described above is performed in reverse. That is, first the operator opens the front cover 3, causing the coupling arms 106 of the front cover 3 to pull the coupling members 105 forward. This movement of the coupling members 105 then rotates the operating members 81 a prescribed angular distance clockwise in a left side view.

In association with the movement of the operating members 81, the developing shutter 44 is moved from the open position to the closed position, and the cartridge shutter 71 is moved from the first open position to the first closed position. As a result, the cover part 49 of the developing shutter 44 closes the developer openings 48, and the cover part 74 of the cartridge shutter 71 closes the toner cartridge openings 68.

Further, the rotating members 104 are in the first position at this time, allowing communication between the fitting grooves 99 and corresponding second guide grooves 103. Thereafter, the operator can pull the process cartridge 4 forward from the main casing 2 and extract the process cartridge 4 therefrom.

6. Toner Agitation and Circulation

Next, the processes for agitating and circulating toner in the process cartridge 4 will be described with reference to FIG. 9.

When the process cartridge 4 is mounted in the main casing 2, a drive force from a drive mechanism (not shown) rotates the agitators 61 and 64 and the augers 16 and 78.

The agitator 61 rotates clockwise in a left side view. By rotating, the agitator 61 agitates toner in the first toner accommodating section 59, while supplying some of the toner to the second toner accommodating section 60 through the gap between the bottom edge of the partitioning wall 58 and the junction between the first peripheral wall 52 and second arcing wall 54.

The agitator 64 rotates counterclockwise in a left side view. By rotating the agitator 64 agitates toner in the second toner accommodating section 60, while supplying some of the toner to the second peripheral wall 55. The rotating agitator 64 also returns some of the toner to the first toner accommodating section 59 through the gap between the bottom edge of the partitioning wall 58 and the junction between the first peripheral wall 52 and second arcing wall 54. In this way, toner is circulated between the first and second toner accommodating sections 59 and 60.

The rotating auger 78 conveys toner in the second peripheral wall 55 toward the left-to-right center of the same, discharging some of the toner from the toner cartridge 6 through the center toner cartridge opening 68 and supplying the toner into the developing device case 13 through the center developer opening 48. Here, toner in the second peripheral wall 55 has a level L1 (indicated by the broken line in FIG. 9) higher than the bottom edge of the toner cartridge openings 68, and the toner cartridge opening 68 is formed on the rear side of the toner cartridge 6 to enable the discharge of toner from the same. In other words, the toner cartridge opening 68 allows the toner to discharge outside from the cartridge when at least part of an opening edge of the toner cartridge opening 68 is positioned at a position lower than a level of the toner accommodated in the toner cartridge 6.

In the meantime, the auger 16 provided on the developing device case 13 side rotates to convey toner supplied into the developing device case 13 out from the center of the developing device case 13 in the left and right directions, returning some of the toner into the toner cartridge 6 through the left and right developer openings 48 and toner cartridge openings 68.

Through this process, toner is agitated in the toner cartridge 6 and circulated between the toner cartridge 6 and developing device case 13.

7. Packaging for a Laser Printer (1) Toner Cartridge Cover

When shipping the laser printer 1 of the preferred embodiment, rather than packaging the process cartridge 4 and main casing 2 separately, the laser printer 1 is packaged with the process cartridge 4 accommodated in the main casing 2.

Figure 13:
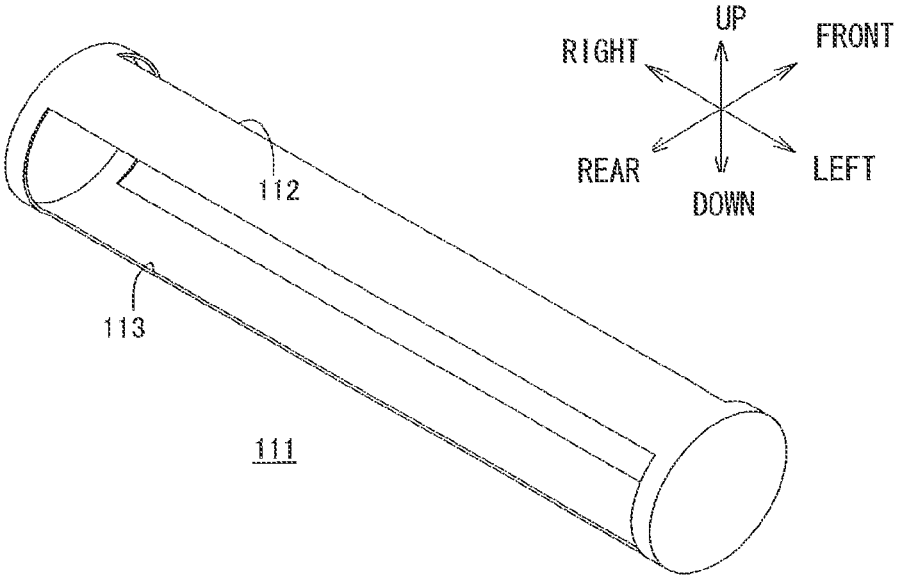
FIG. 13 is a perspective view of a cartridge cover for covering the toner cartridge in the first embodiment.

Before mounting the process cartridge 4 in the main casing 2 in this case, a toner cartridge cover 111 shown in FIG. 13 is mounted on the process cartridge 4 in order to cover both left and right operating members 81 of the toner cartridge 6 (see FIG. 3).

The toner cartridge cover 111 is formed of a flexible material, such as a resin. The toner cartridge cover 111 is substantially cylindrical in shape and is elongated in the left-to-right direction, the direction being based on the toner cartridge cover 111 mounted on the process cartridge 4. Both left and right ends 111A of the cylindrically shaped toner cartridge cover 111 are closed. The left-to-right length of the toner cartridge cover 111 is substantially equivalent to the left-to-right dimension of the toner cartridge 6 at the rear end thereof (specifically, the distance between the left endface of the left fitting member 82 and the right endface of the right fitting member 82. The inner diameter of the toner cartridge cover 111 is greater than the outer diameter of the shutter operating unit 57.

A developing device side opening 113 is formed in the circumferential surface of the toner cartridge cover 111 on one side relative to a radial direction of the toner cartridge cover 111 for receiving the front end of the developing device 12. A toner cartridge side opening 112 is formed in the circumferential surface of the toner cartridge cover 111 on the opposite side from the developing device side opening 113 for receiving the second peripheral wall 55 and the front end of the second toner accommodating section 60 constituting the toner cartridge 6.

The developing device side opening 113 has a substantially rectangular shape, with a left-to-right dimension greater than the left-to-right dimension of the developing device 12 (specifically, the distance between the left edge of the left shutter support part 42 and the right edge of the right shutter support part 42).

The toner cartridge side opening 112 is also substantially rectangular in shape, with substantially the same left-to-right dimension as the developing device side opening 113 and a vertical dimension sufficient to receive the front end of the second toner accommodating section 60.

(2) Inserting the Process Cartridge in the Main Casing

Figure 14:
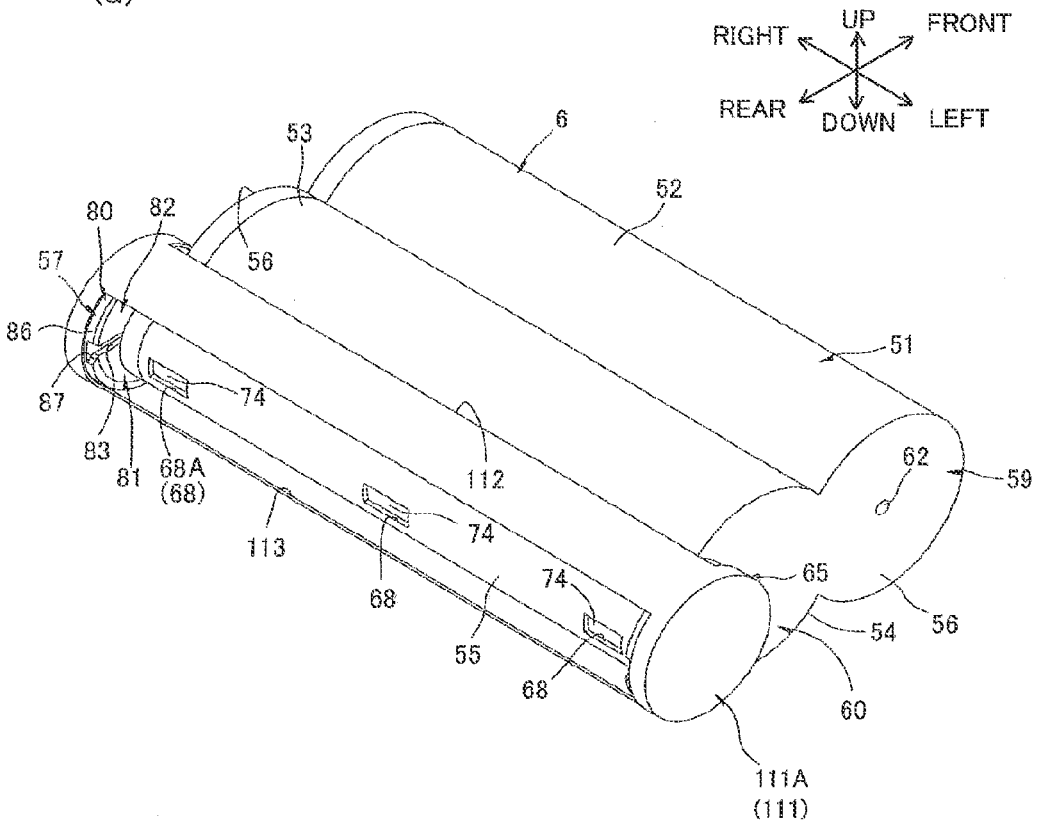
FIG. 14(*a*) is a perspective view of the toner cartridge covered with the cartridge cover as viewed from a upper, front, left side in the first embodiment.
Figure 14:
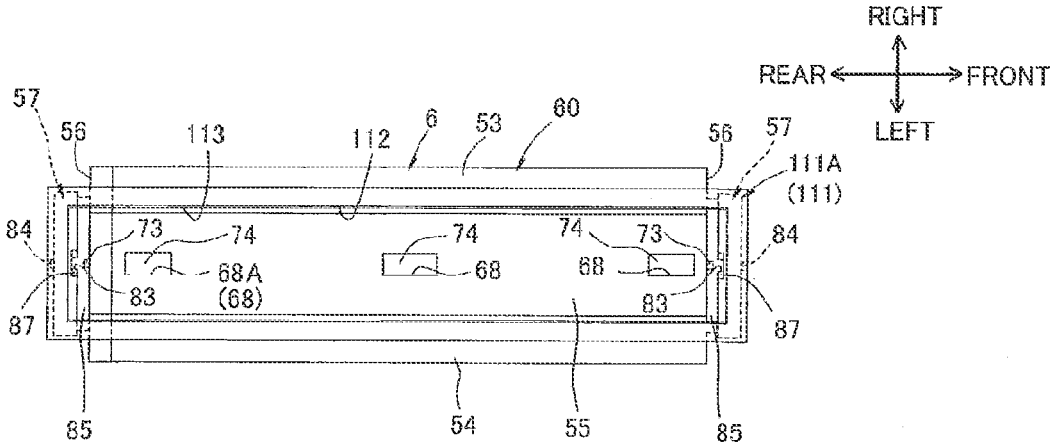

In order to place the process cartridge 4 in the main casing 2, first the toner cartridge cover 111 is mounted on the toner cartridge 6 with the cartridge shutter 71 disposed in the first closed position, as shown in FIG. 14(*a*):

In order to mount the toner cartridge cover 111 on the toner cartridge 6, the operator stretches both left and right ends 111A of the toner cartridge cover 111 on the front side outward in left and right directions so as to widen the left-to-right dimension of the toner cartridge side opening 112. Subsequently, the operator places the toner cartridge cover 111 over the rear end of the toner cartridge 6 from the rear side thereof.

Next, the operator releases the left and right ends 111A of the toner cartridge cover 111 so that the shutter operating units 57 remain accommodated inside the left and right ends 111A of the toner cartridge cover 111. As a result, the left and right ends 111A of the toner cartridge cover 111 return to their original shape and remain fitted around the outer left and right sides of the respective shutter operating units 57.

As shown in FIG. 14(*b*), the left and right ends 111A of the toner cartridge cover 111 press the input members 84 of the corresponding shutter operating units 57 inward in left and right directions, pushing the input members 84 into their retracted positions inside the input member accommodating parts 88. Consequently, the toner cartridge cover 111 restricts operations of the input members 84.

Figure 15:
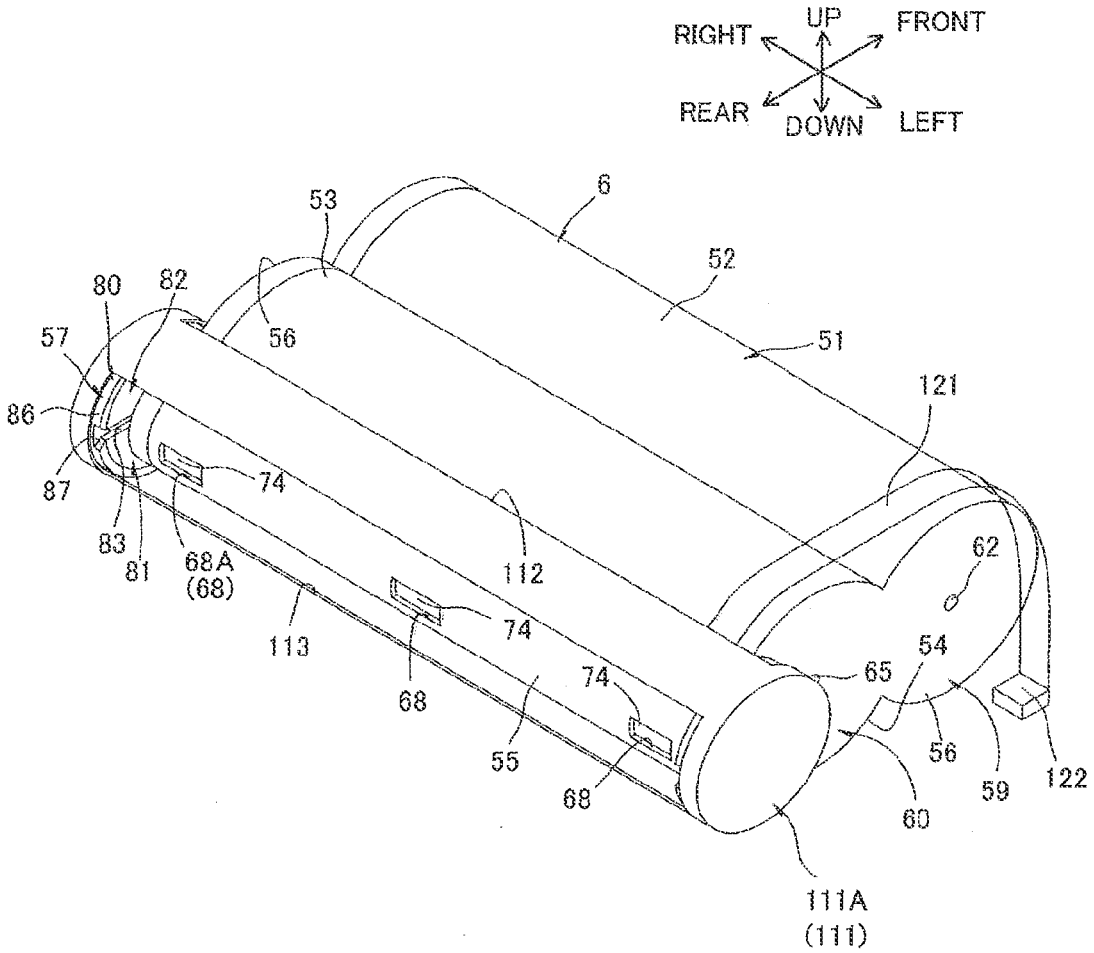
FIG. 15 is a perspective view showing the toner cartridge fixed to the color laser with a tape in the first embodiment.

Next, before inserting the process cartridge 4 into the main casing 2, a masking tape 121 is applied to the toner cartridge 6, as shown in FIG. 15. The masking tape 121 is a long strip of tape. One end of the masking tape 121 is applied to the upper edge of the second peripheral wall 55 constituting the toner cartridge 6 near the left side. A marker 122 is provided on the other end of the masking tape 121. The marker 122 has a substantially rectangular plate shape.

Next, the toner cartridge 6 is mounted in the drum cartridge 5 while the toner cartridge cover 111 and masking tape 121 remain attached thereto. As described above, in order to mount the toner cartridge 6 on the drum cartridge 5, the toner cartridge 6 is assembled to the front of the drum cartridge 5 such that the shutter support parts 42 are inserted between the operating parts 72 of the cartridge shutter 71 and respective shutter operating units 57 of the toner cartridge 6.

Through this operation, the shutter support parts 42 are inserted through the developing device side opening 113 formed in the toner cartridge cover 111 and between the cartridge shutter 71 and shutter operating units 57 of the toner cartridge 6. Hence, the toner cartridge 6 is mounted on the drum cartridge 5 while the toner cartridge cover 111 and masking tape 121 remain attached to the toner cartridge 6.

At this time, the left and right ends 111A of the toner cartridge cover 111 confront the cutout parts 36 formed in the drum frame 7 and are exposed outside the cutout parts 36 on both left and right sides.

Figure 16:
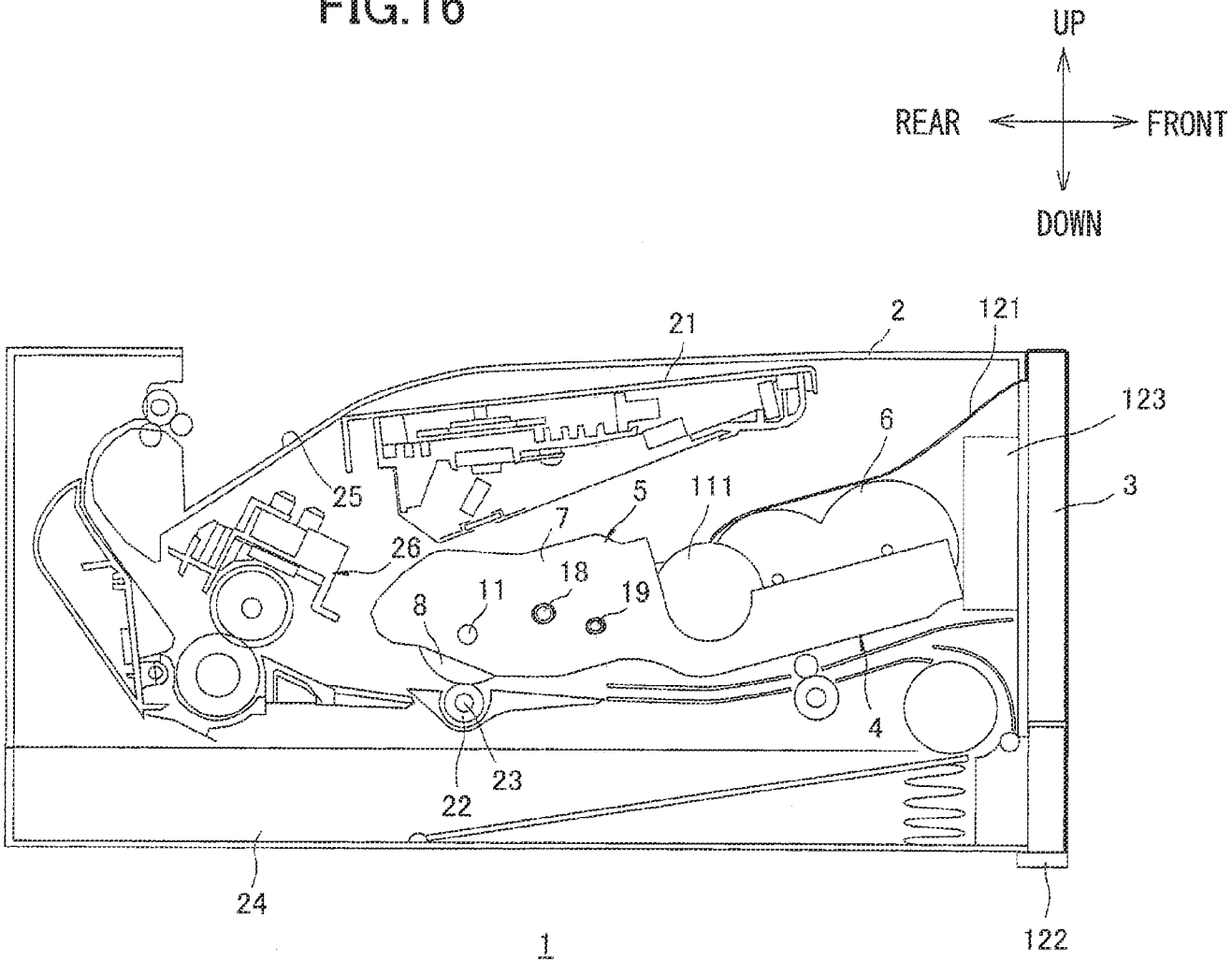
FIG. 16 is a cross-sectional view showing the toner cartridge fixed to the color laser with the tape in the first embodiment.

Next, the process for inserting the process cartridge 4 into the main casing 2 will be described with reference to FIG. 16. In order to mount the process cartridge 4 in the main casing 2, first the front cover 3 is opened, as described above. Next, the ends of the drum shaft 11 in the photosensitive drum 8 are inserted into the respective first guide grooves 102, and the process cartridge 4 is pushed rearward until the ends of the drum shaft 11 reach the rear ends of the first guide grooves 102.

The process cartridge 4 is completely mounted in the main casing 2 when the ends of the drum shaft 11 reach the rear ends of the first guide grooves 102. At this time, the left and right ends 111A of the toner cartridge cover 111 confront the corresponding left and right fitting grooves 99 of the rotating members 104 from the inside thereof.

Consequently, the toner cartridge cover 111 prevents the input members 84 of the operating members 81 from being fitted into the fitting grooves 99 of the rotating members 104, interrupting the associative movement between the front cover 3 and operating members 81. In this way, the developing shutter 44 is held in its closed position while the cartridge shutter 71 is held in its first closed position.

Before closing the front cover 3, the free end of the masking tape 121 is drawn out through the access opening 17 formed in the main casing 2, and a cushioning member 123 is inserted through the access opening 17. The front cover 3 is then closed so that the cushioning member 123 is positioned between the front cover 3 and process cartridge 4, and the free end of the masking tape 121 remains outside the main casing 2. Next, the marker 122 of the masking tape 121 is affixed to the bottom surface of the laser printer 1 on the left side thereof. Through this operation, the process cartridge 4 is now completely accommodated in the main casing 2, as shown in FIG. 16.

(3) Packaging for a Laser Printer (3-1) Packaging Member

The laser printer 1 is packed into a packaging member 124, after the process cartridge 4 has been inserted in the main casing 2 according to the method described above.

Figure 17:
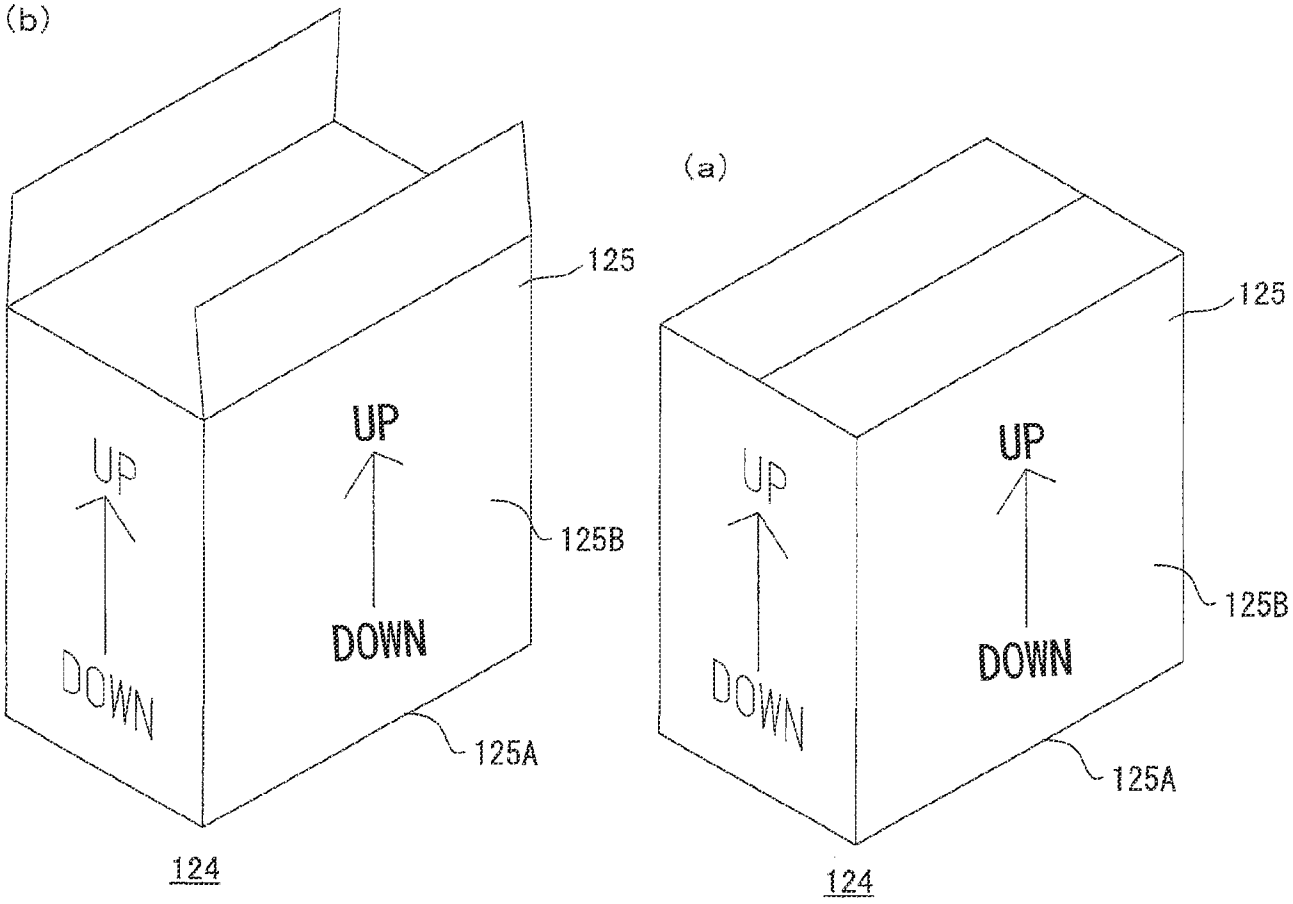
FIG. 17(*a*) and FIG. 17(*b*) are perspective views of packaging member.

As shown in FIGS. 17(*a*), 17(*b*), and 18(*a*), the packaging member 124 includes a packing box 125, a bottom cushioning member 126, and a top cushioning member 127.

The packing box 125 is formed of a thick paper, such as corrugated cardboard, and is configured in a box shape that is elongated vertically. The bottom surface has a smaller surface area than each side surface. In other words, the footprint of the packing box 125 is smaller than the footprint required if the packing box 125 were laid on its side.

The bottom cushioning member 126 is formed of Styrofoam or another material and is roughly block-shaped with a depression in the top surface formed to receive the front end of the laser printer 1. Note that the bottom cushioning member 126 has horizontal outer dimensions corresponding to the horizontal inner dimensions of the packing box 125, so that the bottom cushioning member 126 does not move around in the packing box 125 during transit. The bottom cushioning member 126 is placed in the bottom of the packing box 125 for packaging the laser printer 1.

As with the bottom cushioning member 126, the top cushioning member 127 is formed of Styrofoam or a similar material and is roughly block-shaped with a depression in the bottom surface formed to receive the rear end of the laser printer 1. The horizontal outer dimensions of the top cushioning member 127 correspond to the horizontal inner dimensions of the packing box 125. The packaging box 125 has a bottom surface 125A and a side surface 125B whose dimension is greater than a dimension of the bottom surface 125A.

(3-2) Packaging the Laser Printer

Figure 18:
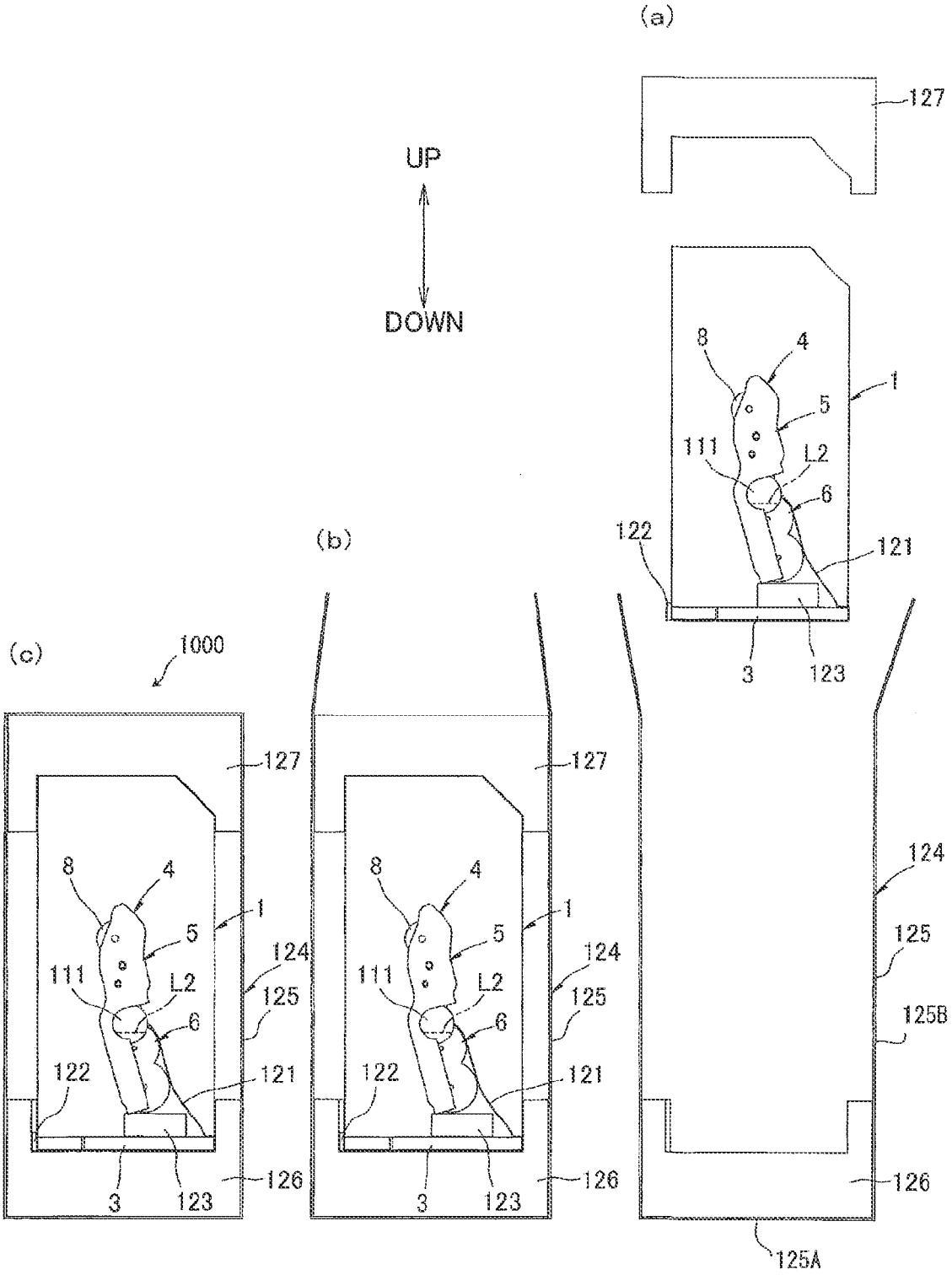
FIG. 18(*a*)-(*c*) are side views showing how to pack the color laser in the packaging member according to the first embodiment.

When packing the laser printer 1, first the top end of the packing box 125 is opened, and the laser printer 1 is positioned above the opening in the packing box 125, with the rear end of the laser printer 1 facing upward, as shown in FIG. 18(*a*). Next, the laser printer 1 is inserted front end first into the packing box 125, and the front end of the laser printer 1 is fitted into the depression formed in the bottom cushioning member 126. The bottom surface 125A faces an installation surface when the packaging member is installed on the installation surface.

Next, the top cushioning member 127 is placed over the top of the laser printer 1 so that the rear end of the laser printer 1 is fitted into the depression formed in the top cushioning member 127, as shown in FIG. 18(*b*). Lastly, the top end of the packing box 125 is closed, as shown in FIG.

Figure 19:
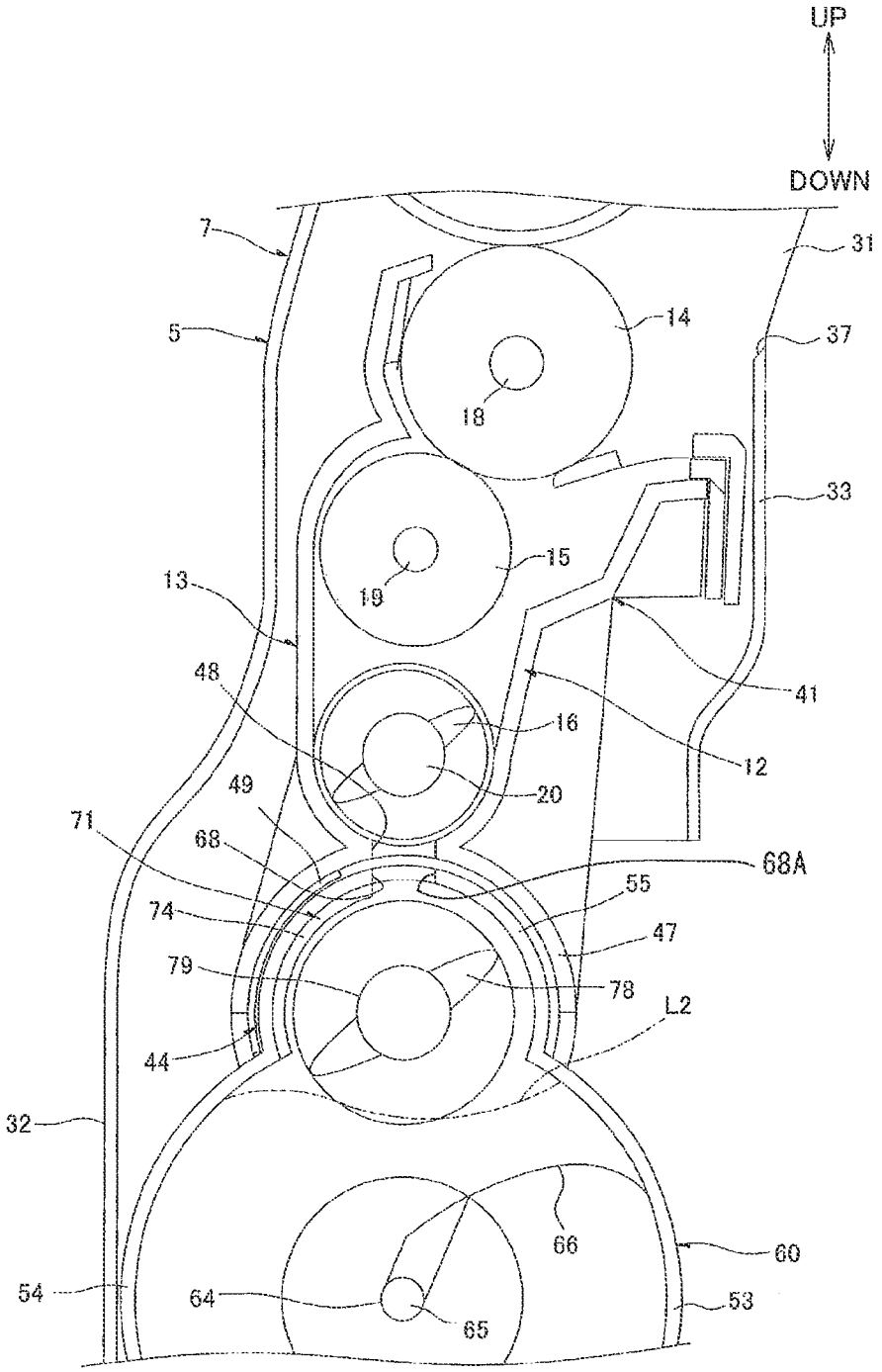
FIG. 19 is a partial cross-sectional view showing the toner cartridge accommodated in a developer unit provided on the color laser in the first embodiment.
Figure 20:
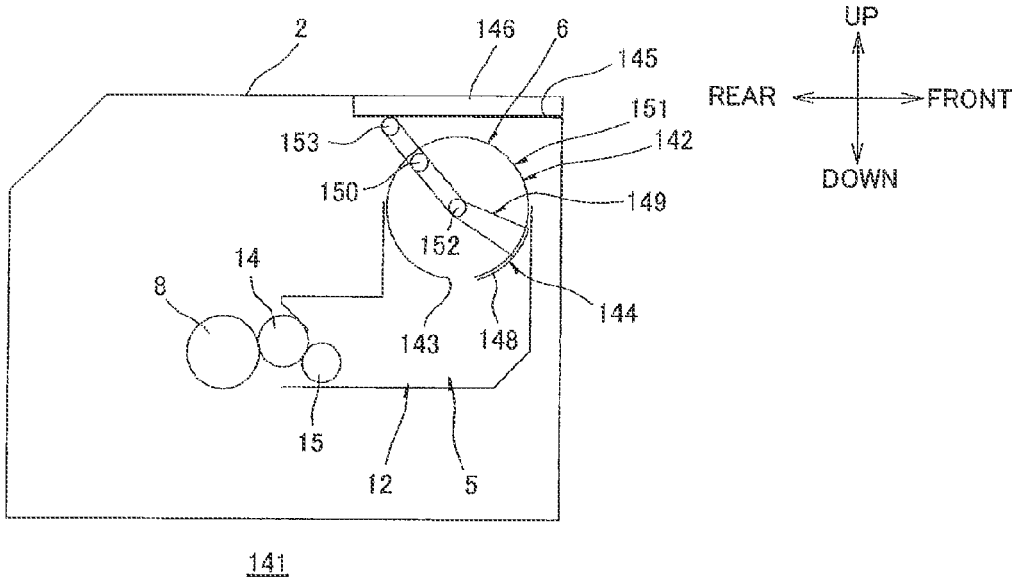
FIG. 20 is a side view of a color laser as an image forming apparatus according to a second embodiment in a state that an image is formed.

18(*c*). This completes the process for packing the laser printer 1 in the packaging member 124. The resulting packaging unit 1000 includes the vertically oriented laser printer 1 packed inside the packaging member 124. Consequently, the rear end of the laser printer 1 faces upward while packed in the packaging member 124. Hence, the toner cartridge openings 68 formed in the rear end of the toner cartridge 6 (see FIG. 15) are arranged on the top end of the toner cartridge 6 when the laser printer 1 is in a packaged state and, therefore, face upward, unlike when the laser printer 1 is in an operational state (see FIG. 11) and the toner cartridge openings 68 face rearward. In other words, the color laser 1 is packaged in the packaging member 124 in such a posture that the toner cartridge 6 is in a second posture (see FIG. 18) where leakage of the toner from the cartridge opening 68 is unlikely to occur as compared with a posture of the color laser 1 in which the toner cartridge 68 is in a first posture (see FIG. 7). Further, the cartridge opening 68 is in a predetermined position (see FIG. 7) when an image is formed, and is in a developer-leakage preventing position angularly offset from the predetermined position when the toner cartridge 6 is in the second posture (see FIG. 18). The developer-leakage preventing position can be set to fall within a prescribed angular range determined depending upon the predetermined position. In this embodiment, the toner cartridge 6 opens diagonally downward when the cartridge opening 68 is in the predetermined position as shown in FIG. 7 and opens upward when the cartridge opening 68 is in the developer-leakage preventing position as shown in FIG. 19.

In this way, the toner cartridge openings 68 are positioned above the first toner accommodating section 59 and second toner accommodating section 60 and are also above a level L2 of toner in the toner cartridge 6 (see FIG. 19), ensuring that toner is not discharged through the toner cartridge openings 68. In other words, the laser printer 1 is packaged in the packaging member 12 in such a posture that the entire opening edge of the toner cartridge openings 68 is positioned at a position higher than the level of the toner accommodated in the toner cartridge 6.

The developing roller 14 supported in the rear end of the developing device 12 is positioned at the top end of the developing device 12 when the laser printer 1 is in a packaged state. Thus, the developing roller 14 is positioned higher than the developer openings 48 and toner cartridge openings 68.

8. Installing the Laser Printer

In order to unpack the laser printer 1 for usage, the top of the packaging member 124 is opened, and the laser printer 1 is extracted from the packaging member 124. The laser printer 1 is then placed on a level installation surface with the discharge tray 25 facing upward.

At this time, the marker 122 is interposed between the bottom edge of the laser printer 1 and the installation surface, preventing the laser printer 1 from lying in a stable, level orientation. In order to place the laser printer 1 in a stable, level orientation, the operator removes the marker 122 from the bottom of the laser printer 1. Subsequently, the operator rotates the front cover 3 forward into the second open position, exposing the access opening 17.

Next, the user pulls the process cartridge 4 out of the main casing 2 through the access opening 17. After removing the process cartridge 4, the user peels off the masking tape 121 from the process cartridge 4 and removes the toner cartridge cover 111. The latter is removed by pulling the left and right ends 111A of the toner cartridge cover 111 outward in left and right directions, thereby widening the toner cartridge side opening 112 so that the toner cartridge cover 111 can be pulled off the shutter operating units 57 and removed from the toner cartridge 6.

After having removed the masking tape 121 and toner cartridge cover 111 from the toner cartridge 6, the toner cartridge 6 is remounted in the main casing 2 according to the process described earlier, and the front cover 3 is closed. At this time, the laser printer 1 is ready to use. Further, the toner cartridge openings 68 formed in the toner cartridge 6 now face rearward, and the level L1 of toner accommodated in the toner cartridge 6 (see FIG. 9) is higher than the lower edges 68A of the toner cartridge openings 68.

9. Operations and Effects (1) With the package and the method of packaging the laser printer 1 according to the present invention, the laser printer 1 is packaged with its rear end facing upward, while the toner cartridge 6 is accommodated inside the laser printer 1, as shown in FIG. 18. In this way, the toner cartridge openings 68 formed in the toner cartridge 6 face upward and are higher than a position at which toner could be discharged from the toner cartridge 6.

Accordingly, rather than increasing the number of boxes required for packaging, this method reduces the size of the box used for packaging by an amount saved by accommodating the toner cartridge in the body of the printer.

Since the printer is transported with the toner cartridge accommodated in the body thereof, vibrations and other disturbances applied to the packaged printer during transport and the like may cause toner to leak from the cartridge and contaminate the printer in some cases.

However, with the laser printer 1 oriented with its rear end facing upward, the toner remains settled in the toner cartridge 6 by its own weight despite vibrations or other disturbances that may be applied to the laser printer 1 during transport. As a result, this method prevents toner from leaking into the laser printer 1 when the laser printer 1 is packaged with the toner cartridge 6 accommodated therein.

(2) Further, when the laser printer 1 is packaged according to the package and packaging method of the present invention, the cartridge shutter 71 is disposed in the first closed position shown in FIG. 7. Hence, the cartridge shutter 71 can restrict toner from leaking out of the toner cartridge openings 68. Accordingly, this construction reliably prevents toner from leaking into the laser printer 1.

(3) When the laser printer 1 is packaged according to the package and packaging method of the present invention, the process cartridge 4 is inserted into the main casing 2 with the toner cartridge cover 111 attached thereto. The toner cartridge cover 111 interferes with the input members 84 of the toner cartridge 6 so that the cartridge shutter 71 is maintained in the first closed position.

Accordingly, the cartridge shutter 71 can be maintained in the first closed position, even when the packaged laser printer 1 is subjected to vibrations or other disturbances, thereby reliably preventing toner from leaking into the laser printer 1.

(4) When the laser printer 1 is packaged according to the package and packaging method of the present invention, the developing roller 14 is arranged above the toner cartridge openings 68 and developer openings 48, as shown in FIG. 19.

Therefore, even if the user were to package a used laser printer 1 to be sent for repairs, for example, the laser printer 1 would be packaged so that no toner is present near the developing roller 14. This configuration suppresses toner that may have become deposited on sealing parts or the like provided near the developing roller 14 from falling inside the laser printer 1.

(5) With the package and the packaging method for the laser printer 1 according to the present invention, the footprint of the packing box 125 is smaller than the footprint of the packing box 125 when laid on its side (i.e., when the packing box is placed in the same orientation as the laser printer 1 in its operational state), as shown in FIG. 17. Hence, packaged laser printers 1 can be stored with better space savings.

(6) When the laser printer 1 is packaged according to the package and packaging method of the present invention with the developing unit (i.e., the toner cartridge 6 and developing device 12) accommodated in the main casing 2, the level L2 of toner in the toner cartridge 6 is lower than the bottom edges 68A of the toner cartridge openings 68, as shown in FIG. 19. This arrangement further prevents toner from leaking into the laser printer 1.

10. Variations of the Embodiment

In the first embodiment described above, the compressed springs 89 are provided between the bottom wall (inner wall in the left-to-right direction) of the input member accommodating parts 88 and the inner side of the corresponding input members 84 with respect to the left-to-right direction. However, a leaf spring, sponge, or the like may be used in place of the compressed springs 89.

Further, when the laser printer 1 is arranged in its operational state in the first embodiment, the toner cartridge openings 68 formed in the toner cartridge 6 face rearward. However, as shown in FIGS. 20-24, a laser printer 141 according to a second embodiment of the present invention may be provided with a toner cartridge 142 having toner cartridge openings 143. According to the second embodiment, the toner cartridge openings 143 face downward when the laser printer 141 is arranged in its operational state.

More specifically, the toner cartridge 142 has a cartridge case 151 that is mounted on and removed from the drum cartridge 5 vertically. The cartridge case 151 has a substantially hollow cylindrical shape and accommodates toner. The toner cartridge openings 143 are formed in the bottom portion of the cartridge case 151, penetrating the peripheral wall of the same.

A cartridge shutter 144 is also provided on the toner cartridge 142 for opening and closing the toner cartridge openings 143. The cartridge shutter 144 includes a cover member 148, and a pair of left and right arms 149.

The cover member 148 is formed in a curved plate shape elongated in the left-to-right direction. The curve of the cover member 148 conforms to the peripheral surface of the cartridge case 151.

Each of the arms 149 is substantially rod-shaped and extends vertically. The arms 149 are rotatably connected to the left and right sides of the cartridge case 151 via connecting parts 152 provided one in substantially the vertical center of each arm 149. The bottom ends of the arms 149 are connected to the respective left and right ends of the cover member 148. A substantially rod-shaped grip 153 extending in the left-to-right direction bridges the top ends of the arms 149 for coupling the same.

In addition, the portions of the arms 149 above the connecting parts 152 are capable of bending at hinge parts 150. The portion of the arms 149 above the hinge parts 150 move between a horizontal position (see FIG. 23) rotated forward about the hinge part 150 to approximately the horizontal, and an erect position (see FIG. 22) erected so the entire arms 149 extend substantially linearly.

With the arms 149 in their erect state, the cartridge shutter 144 rotates about the connecting parts 152 between a first closed position (see FIG. 22) at which the cover member 148 covers the toner cartridge openings 143 from the bottom, and a first open position (see FIG. 20) at which the cover member 148 does not cover the toner cartridge openings 143.

An access opening 145 is formed in the top of the main casing 2 near the front side thereof. A cover 146 is rotatably provided on the top of the main casing 2 and is capable of pivoting between a second closed position (see FIG. 20) for covering the access opening 145, and a second open position (see FIG. 21) for exposing the access opening 145.

After installing the laser printer 141 in a level state and mounting the toner cartridge 142 on the drum cartridge 5, the laser printer 141 can be operated when the cartridge shutter 144 is disposed in the first open position. When the cartridge shutter 144 is in the first open position, toner accommodated in the toner cartridge 142 is discharged downward through the toner cartridge openings 143 and supplied into the developing device 12.

Figure 21:
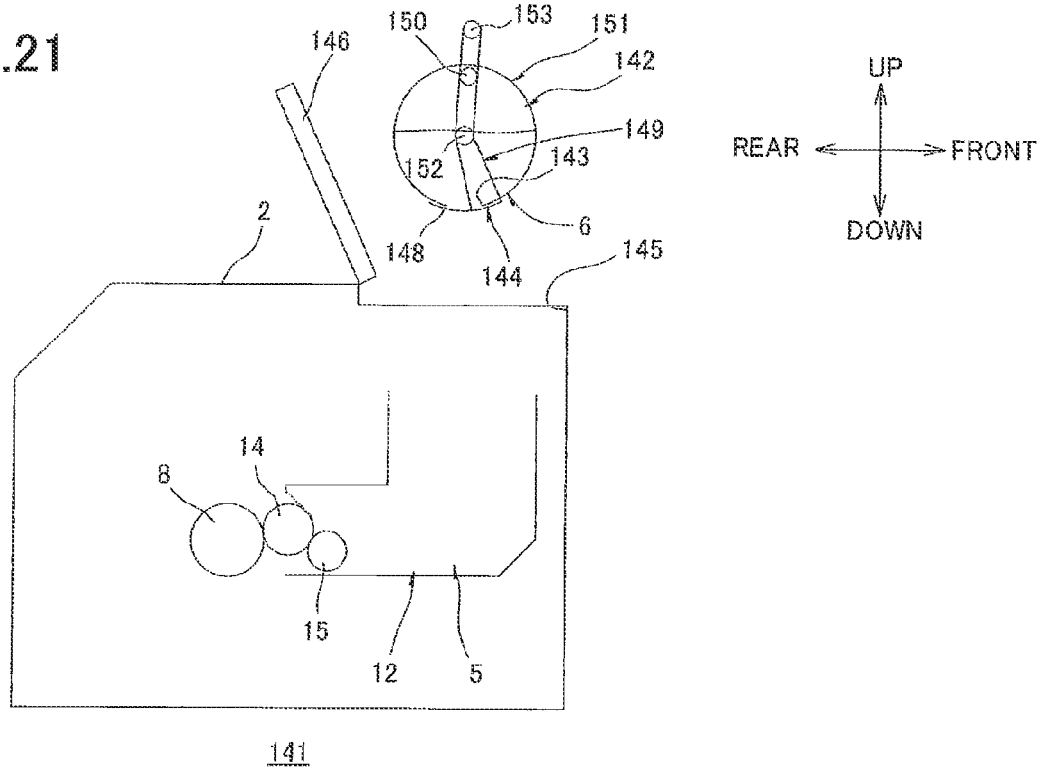
FIG. 21 is a side view of the color laser of FIG. 20 in a state that a toner cartridge is removed from the color laser in the second embodiment.
Figure 22:
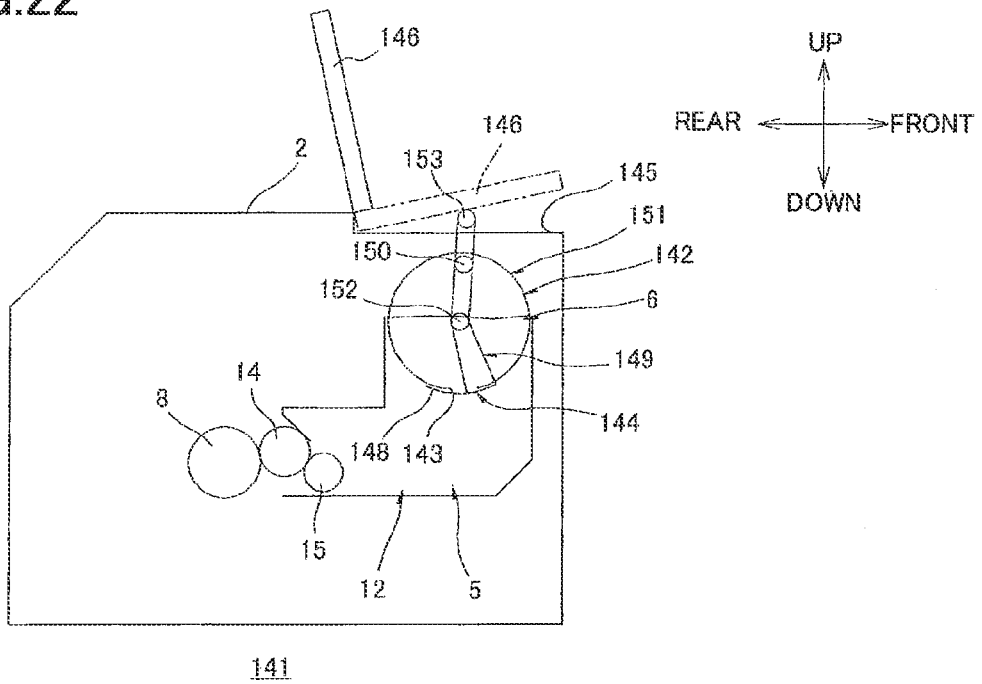
FIG. 22 is a side view of the color laser of FIG. 20 in a state that the toner cartridge is being installed in the color laser in the second embodiment.

In order to package the laser printer 141, the toner cartridge 142 is first mounted inside the main casing 2. This is achieved by opening the cover 146 to expose the access opening 145, as shown in FIG. 21, and by inserting the toner cartridge 142 downward through the access opening 145 into the main casing 2, as illustrated in FIG. 22.

At this time, the portion of the arms 149 above the corresponding hinge parts 150 are in the erect position, protruding above the access opening 145. Accordingly, even if the user were to attempt to rotate the cover 146 into the second closed position, the cover 146 would halt before reaching the second position when contacting the top ends of the arms 149, as indicated by the broken line in FIG. 22.

Figure 23:
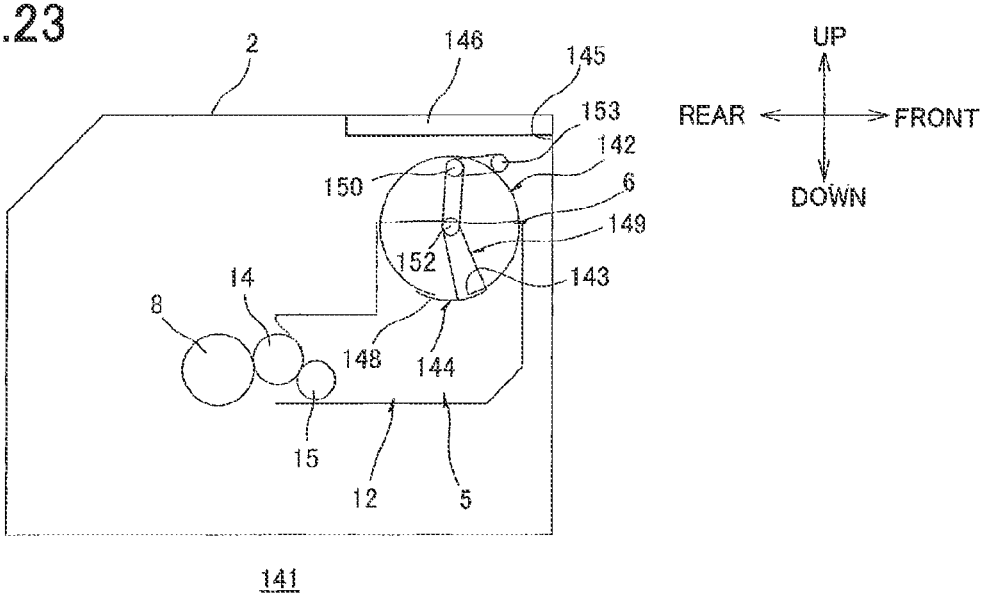
FIG. 23 is a side view of the color laser of FIG. 22 in a state that the toner cartridge has been installed in the color laser in the second embodiment.

As shown in FIG. 23, the portions of the arms 149 above the corresponding hinge parts 150 have been bent forward into the horizontal position and are accommodated inside the main casing 2, rather than protruding out of the access opening 145. Thereafter, the cover 146 can be rotated into its second closed position, thereby completing the operation to mount the toner cartridge 142 in the main casing 2. Note that the toner cartridge 142 is accommodated in the main casing 2 while the cartridge shutter 144 is maintained in its first closed position.

Figure 24:
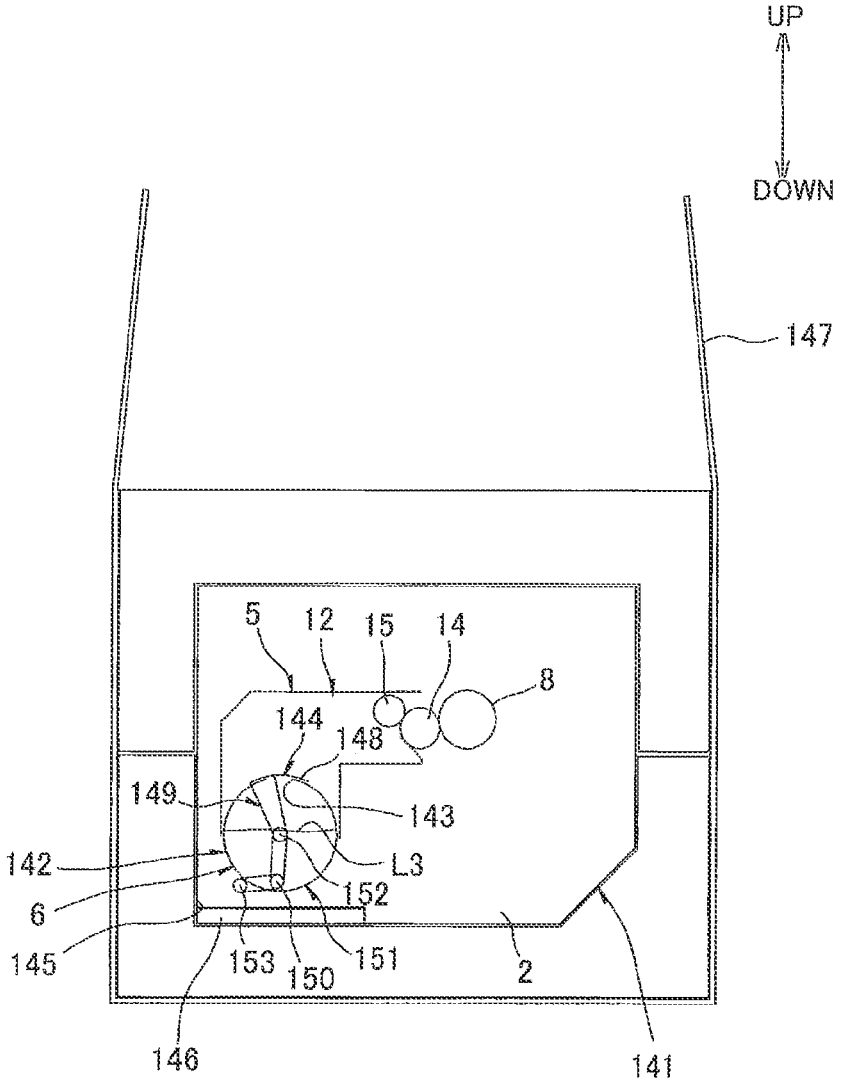
FIG. 24 is a side view showing a state that the color laser is packaged in a packaging member in the second embodiment.

When packing the laser printer 141, the laser printer 141 is packed into a packing box 147 with its bottom end facing upward, as shown in FIG. 24. With this method, the toner cartridge openings 143 formed in the bottom of the toner cartridge 142 and facing downward when the laser printer 141 is in its operational state are disposed on the top of the toner cartridge 142 facing upward when the laser printer 141 is in the packaged state. Accordingly, the toner cartridge openings 143 are positioned higher than a level 13 of toner accommodated in the toner cartridge 142.

In order to unpack the laser printer 141 for usage, the laser printer 141 is extracted from the packing box 147 and placed on a level installation surface. Next, the user opens the cover 146 and bends the top portions of the arms 149 back to their erect position. Subsequently, the user extracts the toner cartridge 142 from the main casing 2, and the opening and closing operations of the cartridge shutter 144 are enabled.

Next, the user remounts the toner cartridge 142 in the main casing 2. At this time, when the arms 149 are in their erected state and the cartridge shutter 144 is in its first closed position, the arms 149 protrude out of the main casing 2 through the access opening 145, preventing the cover 146 from being closed, as described above.

Hence, the user will notice that the cartridge shutter 144 is still in its first closed position. Upon noticing that the cartridge shutter 144 is in its first closed position, the user presses the arms 149 rearward, rotating the cartridge shutter 144 counterclockwise in a left side view about the connecting parts 152 and shifting the cartridge shutter 144 from its first closed position to its first open position. Consequently, the arms 149 are accommodated in the main casing 2 rather than protruding out through the access opening 145, enabling the user to close the cover 146.

At this time, the toner cartridge openings 143 are open, and toner is discharged downward through the toner cartridge openings 143. Hence, the laser printer 141 is now operational.

While the invention has been described in detail with reference to the embodiments thereof, it would be apparent to those skilled in the art that various changes and modifications may be made therein without departing from the spirit of the invention.

Figure 25:
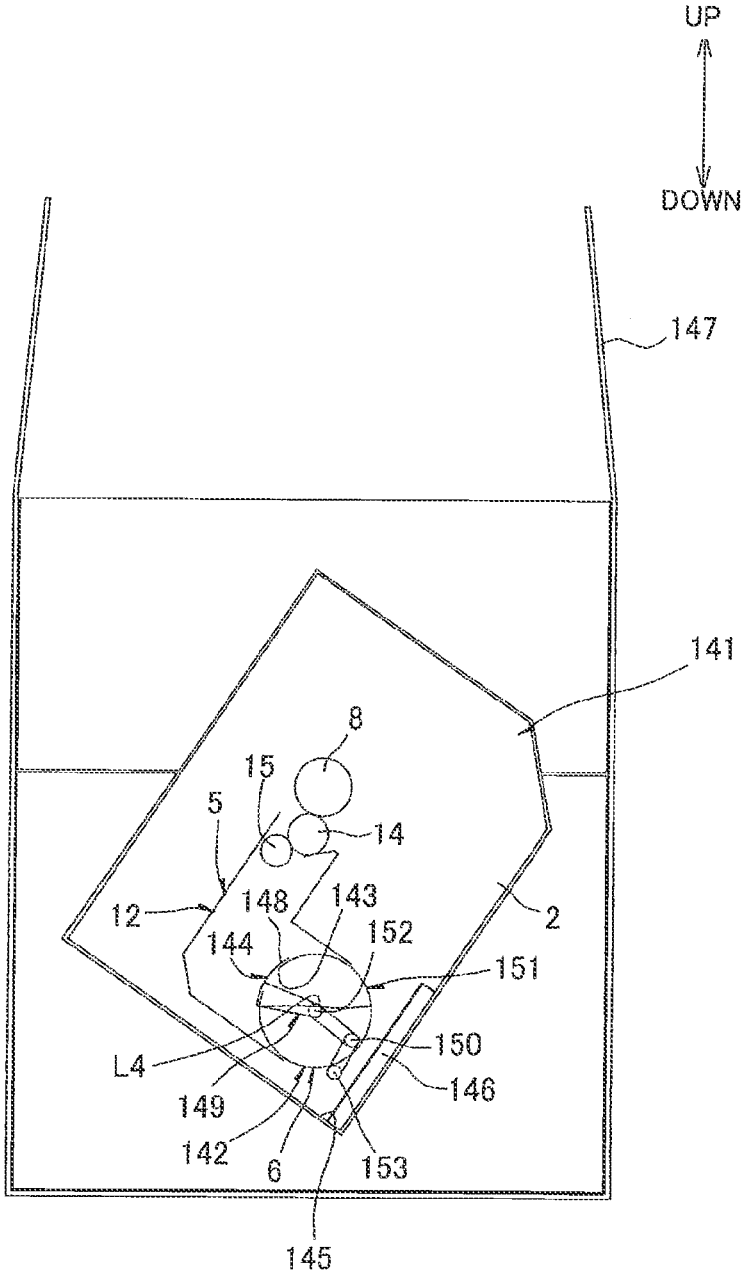
FIG. 25 is a side view showing a state that the color laser is packaged in a packaging member in a modification of the second embodiment.

For example, when packaging the laser printer 141 in the packing box 147, the laser printer 141 can be tilted with its bottom edge facing upward at an angle, as illustrated in FIG. 25. In this case, the toner cartridge openings 143 formed in the bottom of the toner cartridge 142 and facing downward when the laser printer 141 is in its operational state are facing diagonally upward when the laser printer 141 is in the packaged state and are positioned above a level L4 of toner accommodated in the toner cartridge 142.

What is claimed is:

1. A packaging unit comprising:

an image forming apparatus into which a cartridge accommodating developer therein is detachably mounted, the cartridge being formed with a first opening for allowing the developer to discharge outside from the cartridge when the cartridge is in a first posture, the cartridge being in the first posture when an image is formed; and a packaging member in which the image forming apparatus is packaged in such a posture that the cartridge is in a second posture where leakage of the developer from the first opening is unlikely to occur as compared with a posture of the image forming apparatus in which the cartridge is in the first posture, wherein the image forming apparatus further includes a main casing and a cover member, the main casing having an opening section through which the cartridge is inserted, the cover member being movable between a second open position and a second closed position, the cover member exposing the opening section when the cover member is in the second open position, the cover member covering the opening section when the cover member is in the second closed position, wherein the cartridge includes a shutter member movable between a first open position and a first closed position, the shutter member exposing the first opening and allowing the developer to pass through the first opening when the shutter member is in the first open position, the shutter member covering the first opening when the shutter member is in the first closed position, the shutter member moving from the first closed position to the first open position in conjunction with movement of the cover member from the second open position to the second closed position, the shutter member moving from the first open position to the first closed position in conjunction with movement of the cover member from the second closed position to the second open position, and wherein the packaging unit further comprises an interfering member configured to interrupt associative movements between the shutter member and the cover member so as to maintain the shutter member in the first closed position when the image forming apparatus is packaged in the packaging member.

2. The packaging unit according to claim 1, wherein the first opening is in a predetermined position when the cartridge is in the first posture, the first opening being in a developer-leakage preventing position angularly offset from the predetermined position when the cartridge is in the second posture.

3. The packaging unit according to claim 2, wherein the developer-leakage preventing position is set to fall within a prescribed angular range determined depending upon the predetermined position.

4. The packaging unit according to claim 1, wherein the cartridge opens downward or diagonally downward when the cartridge is in the first posture, the cartridge opening upward or diagonally upward when the cartridge is in the second posture.

5. The packaging unit according to claim 1, further comprising a developer unit including a developer carrying member that is configured to carry the developer from the cartridge, the developer unit having a second opening configured to communicate with the first opening, wherein the developer carrying member is disposed at a position higher than both positions of the first opening and the second opening when the image forming apparatus is packaged in the packaging member.

6. The packaging unit according to claim 1, wherein the packaging member has a bottom surface and a side surface, the side surface having an area greater than an area of the bottom surface, and wherein the image forming apparatus is packaged in such a posture that the image forming apparatus rotates 90 degrees with respect to a posture of the image forming apparatus in which the image is formed.

7. The packaging unit according to claim 1, wherein the first opening has a bottom edge, wherein a level of the developer accommodated in the cartridge is higher than or equal to the bottom edge when the image is formed, and wherein the level of the developer accommodated in the cartridge is lower than the bottom edge when the image forming apparatus is packaged in the packaging member.

8. A method for packaging an image forming apparatus in which a cartridge accommodating developer therein is mounted, the cartridge being formed with a first opening for allowing the developer to be discharged outside from the cartridge, the cartridge having a shutter member movable between a first open position and a first closed position, the shutter member at the first open position exposing the first opening and allowing the developer to pass through the first opening, the shutter member at the first closed position covering the first opening, the image forming apparatus including a main casing and a cover member, the main casing having an opening section through which the cartridge is mounted, the cover member being movable between a second open position and a second closed position, the cover member exposing the opening section when the cover member is in the second open position, the cover member covering the opening section when the cover member is in the second closed position, the method comprising:

a covering step, covering the cartridge with an interfering member to maintain the shutter member in the first closed position;

a mounting step, mounting the cartridge covered with the interfering member into the image forming apparatus such that the mounted cartridge is in a first posture, the cartridge being in the first posture when an image is formed; and a packaging step, packaging the image forming apparatus with the cartridge mounted therein in a packaging member in such a posture that the mounted cartridge is in a second posture different from the first posture, wherein leakage of the developer from the first opening is unlikely to occur when the mounted cartridge is in the second posture as compared with a posture of the image forming apparatus in which the mounted cartridge is in the first posture.

9. The method according to claim 8, wherein the first opening is in a predetermined position when the cartridge is in the first posture, the first opening being in a developer-leakage preventing position angularly offset from the predetermined position when the cartridge is in the second posture.

10. The method according to claim 9, wherein the developer-leakage preventing position is set to fall within a prescribed angular range determined depending upon the predetermined position.

11. The method according to claim 8, wherein the image forming apparatus is packaged in the packaging member in such a posture that the cartridge opens upward or diagonally upward in the packaging step.

12. The method according to claim 8, wherein in the packaging step, the image forming apparatus is packaged in the packaging member in such a posture that a developer carrying member of a developer unit is disposed at a position higher than both positions of the first opening and a second opening of the developer unit, the developer carrying member configured to carry the developer from the cartridge, the second opening communicating with the first opening.

13. The method according to claim 8, wherein in the packaging step, the image forming apparatus is packaged in the packaging member in such a posture that the image forming apparatus rotates 90 degrees with respect to a posture of the image forming apparatus in which the image is formed, the packaging member having a bottom surface and a side surface, the side surface having an area greater than an area of the bottom surface.

14. The method according to claim 8, wherein in the packaging step, the image forming apparatus is packaged in the packaging member in such a posture that a level of the developer accommodated in the cartridge is lower than a bottom edge of the first opening, the level of the developer accommodated in the cartridge being higher than or equal to the bottom edge when the image is formed.

15. A packaging unit comprising:

an image forming apparatus into which a cartridge accommodating developer therein is detachably mounted, the cartridge being formed with a first opening for allowing the developer to discharge outside from the cartridge; and a packaging member in which the image forming apparatus with the cartridge mounted therein is packaged, wherein the image forming apparatus further includes a main casing and a cover member, the main casing having an opening section through which the cartridge is inserted, the cover member being movable between a second open position and a second closed position, the cover member exposing the opening section when the cover member is in the second open position, the cover member covering the opening section when the cover member is in the second closed position, wherein the cartridge includes a shutter member movable between a first open position and a first closed position, the shutter member exposing the first opening and allowing the developer to pass through the first opening when the shutter member is in the first open position, the shutter member covering the first opening when the shutter member is in the first closed position, the shutter member moving from the first closed position to the first open position in conjunction with movement of the cover member from the second open position to the second closed position, the shutter member moving from the first open position to the first closed position in conjunction with movement of the cover member from the second closed position to the second open position, and wherein the packaging unit further comprises an interfering member configured to interrupt associative movements between the shutter member and the cover member so as to maintain the shutter member in the first closed position when the image forming apparatus is packaged in the packaging member.

* * * * *